US009981762B2

(12) United States Patent
Chalmers

(10) Patent No.: US 9,981,762 B2
(45) Date of Patent: May 29, 2018

(54) PALLET WRAPPING MACHINERY

(71) Applicant: Integrated Packaging Australia Pty Ltd., Reservoir (AU)

(72) Inventor: Neil Chalmers, Reservoir (AU)

(73) Assignee: INTEGRATED PACKAGING AUSTRALIA PTY. LTD., Reservoir, Victoria (AU)

( * ) Notice: Subject to any disclaimer, the term of this patent is extended or adjusted under 35 U.S.C. 154(b) by 539 days.

(21) Appl. No.: 14/412,700

(22) PCT Filed: Jul. 4, 2013

(86) PCT No.: PCT/AU2013/000727
§ 371 (c)(1),
(2) Date: Jan. 5, 2015

(87) PCT Pub. No.: WO2014/005181
PCT Pub. Date: Jan. 9, 2014

(65) Prior Publication Data

US 2015/0151861 A1 Jun. 4, 2015

(30) Foreign Application Priority Data

Jul. 6, 2012 (AU) ..... 2012902888

(51) Int. Cl.
*B65B 11/04* (2006.01)
*B65D 19/00* (2006.01)
*B65B 61/10* (2006.01)

(52) U.S. Cl.
CPC ..... *B65B 11/045* (2013.01); *B65D 19/00* (2013.01); *B65B 61/10* (2013.01)

(58) Field of Classification Search
CPC ..... B65B 11/045; B65B 61/10; B65B 11/006; B65B 11/585; B65B 61/06; B65B 2210/14; B65D 19/00
(Continued)

(56) References Cited

U.S. PATENT DOCUMENTS 3,514,920 A * 6/1970 Hoffler ..... B65B 11/045 53/214
4,077,179 A * 3/1978 Lancaster ..... B65B 11/045 100/15

(Continued)

FOREIGN PATENT DOCUMENTS

CA 1215910 A 12/1986

*Primary Examiner* — Hemant M Desai
*Assistant Examiner* — Lucas Palmer
(74) *Attorney, Agent, or Firm* — Wenderoth, Lind & Ponack, L.L.P.

(57) ABSTRACT

The specification discloses a wrapping film handling mechanism (4) for use with loaded pallet wrapping machinery (10) including a rotatable turntable (11) on which a loaded pallet is placed for wrapping, plastic wrapping film being dispensed onto the loaded pallet with a wrapping direction opposite to a rotation direction of the turntable (11), the film handling mechanism (4) having a pair of gripping jaws (24, 25) pivotally mounted to move between a first inactive and lowered position and a second elevated active position, each said gripping jaw (24, 25) having a gripping portion (84, 85) along one zone that engages wrapping film when the gripping jaws (24, 25) are in the second elevated active position, the handling mechanism including actuation means (114, 115, 31, 90, 91, 93, 94, 96, 97, 120) to move said gripping jaws (24, 25) selectably from said first lowered inactive position to said second elevated active position, said pair of gripping jaws (24, 25) being urged by spring means (42) towards one of said first lowered inactive position or said second elevated active position, said wrapping film handling mechanism (4) further including a film pressing arrangement (21) being movable from a first inactive position to a second active position, said actuation means including engagement and activation means (31, 90, 91, 93, 94, 96, 97, 120) carried by said film pressing arrangement (21) to cause the film gripping jaws (24, 25) to move against forces applied by said (Continued)

spring means (42) as the film pressing arrangement moves between said first inactive and said second active positions.

20 Claims, 23 Drawing Sheets

(58) Field of Classification Search
USPC ..... 53/399, 587, 588, 389.1–389.3, 556
See application file for complete search history.

(56) References Cited

U.S. PATENT DOCUMENTS 4,152,879 A * 5/1979 Shulman ..... B65B 11/045 53/211
4,204,377 A * 5/1980 Lancaster ..... B65B 11/045 53/399
4,216,640 A * 8/1980 Kaufman ..... B65B 11/045 53/556
4,235,062 A * 11/1980 Lancaster, III ..... B65B 11/045 53/399
4,255,918 A * 3/1981 Lancaster ..... B65B 11/045 53/556
4,271,657 A * 6/1981 Lancaster, III ..... B65B 11/045 53/138.4
4,300,326 A * 11/1981 Stackhouse ..... B65B 11/045 53/211
4,432,185 A * 2/1984 Geisinger ..... B65B 11/045 53/138.2
4,545,182 A * 10/1985 McDowell, Jr. ..... B65B 11/008 53/556
4,563,863 A * 1/1986 Humphrey ..... B65B 11/045 53/556
4,619,102 A * 10/1986 Geisinger ..... B65B 11/045 53/399
4,972,656 A * 11/1990 Haugstad ..... A01F 15/071 53/176
4,995,224 A * 2/1991 Yourgalite ..... B65G 61/00 53/540
5,005,335 A * 4/1991 Yourgalite ..... B65G 61/00 53/399
5,138,818 A * 8/1992 Humphrey ..... B65B 11/045 53/211
5,168,691 A * 12/1992 Errani ..... B65B 11/045 53/211
5,187,916 A * 2/1993 Errani ..... B65B 11/04 294/116
5,195,297 A * 3/1993 Lancaster ..... B65B 11/045 53/176
5,408,808 A * 4/1995 Masuda ..... B65B 11/045 53/556
5,430,995 A * 7/1995 Cere ..... B65B 11/045 53/375.9
5,452,566 A * 9/1995 Benhamou ..... B65B 11/045 53/389.3
5,722,924 A * 3/1998 Hill ..... B65H 27/00 492/24
5,941,049 A * 8/1999 Lancaster, III ..... B65B 11/045 53/399
6,164,047 A * 12/2000 Rossi ..... B65B 11/045 53/556
6,185,900 B1 * 2/2001 Martin ..... B65B 11/045 53/118
6,269,610 B1 * 8/2001 Lancaster, III ..... B65B 11/045 53/399
6,360,512 B1 * 3/2002 Marois ..... B65B 11/006 53/399
6,474,051 B1 * 11/2002 Hannen ..... B65B 9/026 53/556
6,761,017 B1 * 7/2004 Rossi ..... B65B 11/045 53/211
7,707,802 B2 * 5/2010 Forrest ..... B65B 11/006 53/389.2
8,099,935 B2 * 1/2012 Forni ..... B65B 11/045 53/399
2002/0020145 A1 * 2/2002 Matsumoto ..... B65B 11/006 53/399
2002/0056253 A1 * 5/2002 DeGrasse ..... B65B 11/045 53/399
2003/0093974 A1 * 5/2003 Rossi ..... B65B 11/045 53/399
2003/0140599 A1 * 7/2003 Forrest ..... B65B 11/045 53/399
2004/0177592 A1 * 9/2004 Lancaster, III ..... B65B 11/045 53/399
2004/0182050 A1 * 9/2004 Pieri ..... B65B 11/045 53/556
2007/0157557 A1 * 7/2007 Lancaster, III ..... B65B 11/045 53/399
2009/0293435 A1 * 12/2009 Johnson ..... B65B 11/025 53/461
2011/0030317 A1 * 2/2011 Murarotto ..... B65B 11/045 53/399
2012/0079929 A1 * 4/2012 Ciou ..... B26D 5/16 83/375
2013/0312366 A1 * 11/2013 Ciou ..... B65B 11/045 53/203

* cited by examiner

PALLET WRAPPING MACHINERY

FIELD OF THE INVENTION

The present invention relates to improvements in machinery for wrapping goods placed or stacked on pallets with plastic material film web of the stretch and cling type.

BACKGROUND OF THE INVENTION

It is commonplace for goods suppliers to stack goods on pallets which are then transported to end users or intermediaries in the supply chain such as retailers and wholesalers. Typically the goods are held in place on the pallets by being wrapped with several layers of plastic stretch film which must, at some stage, be removed to provide access to the goods on the pallet. Machinery for automatically wrapping goods on pallets with plastic stretch film is known. Such machines typically comprise a rotary turntable on which a pallet stacked with goods is placed for rotation during a wrapping process. A vertical column positioned adjacent the turntable supports a roll of packaging plastic stretch film with its axis generally vertical whereby the film can be drawn from the roll and onto the goods on the pallet as the turntable is rotated. The support structure for the plastic film roll is driven upwardly/downwardly to sequentially lay overlapping layers of film web on the goods on the pallet. At the end of this process, the film in some machines is gripped by a pair of gripping jaws and is then cut by a suitable mechanism including hot wire cutting mechanisms with the cut wrapped film being pressed and adhered to the film covering the goods on the pallet. The film extending from the roll remains held by the gripping jaws until the wrapping process is recommenced with a new pallet.

Fully automated pallet wrapping machines of the aforementioned kind are often driven by pneumatic actuators which require a compressed air supply system. Normally this is supplied beneath the rotatable turntable but necessarily requires the turntable load carrying surface to be relatively elevated to fit the pneumatic air supply equipment thereunder. This then requires conveyor systems to load stacked pallets on the turntable or, alternatively, the use of mechanized lift trucks. There are, however, many businesses that have the need for wrapping loaded pallets but which do not have any compressed air supply nor do they have the space or the desire to have fully automated wrapping machines.

U.S. Pat. No. 4,216,640 discloses a pallet wrapping machine of the aforementioned type. In this disclosure, a pair of film gripping arms are carried on the rotatable turntable and are raised from an opposed position approximately parallel to the turntable supporting surface to an elevated film gripping position by means of pneumatic actuators. One of the gripping arms is provided with an electrical resistance wire acting as a cutting means to separate the film wrapped from remaining film on the film supply roll. The last layer of film is laid onto the wrapped goods on the pallet with the lower edge of the film web positioned adjacent the top surface of the pallet. The confronting gripping zones of the gripping arms, in the elevated gripping position also grip the film web from a position adjacent the top surface of the pallet to fully grip the width of the film web.

Canadian patent specification no. 1215910 also discloses a pallet wrapping machine generally of the aforementioned type but intended for use with a web that is not treated for self adherence to itself. The disclosed machine includes a mechanism for forming the wrapping web into a rope after leaving the supply roll and the machinery further includes clamping means for holding the rope formed web material, cutting means for cutting the rope formed web material and securing means such as a stapler for securing the roped formed web material to a previously laid layer of web material.

It is becoming more common for receivers of goods wrapped on pallets n the aforementioned manner to provide automated or semi automated inward handling machines to minimise manual labour required. It has been found that the tail end of the wrapped plastic film web may detach from the wrapped film web surrounding the goods stacked on the pallet. There are a variety of reasons for this including the structure of certain pallet wrapping machines, environmental conditions and the stored energy in the stretched plastic stretch film itself. However, if this does occur with the tail end hanging down below the pallet itself, automated inward handling machines are often caused to malfunction or not function defeating any advantages provided by such machinery. In such circumstances the detached film tail ends might need to be reattached manually by any suitable means or the packed pallet might simply be returned to the supplier at the suppliers cost.

The preferred aim of the present invention is to provide improvements in pallet wrapping machines or parts thereof that will enable the use of automated inward handling machinery with pallets wrapped by such machines.

A further preferred aim of the present invention is to provide apparatus that might be retrofitted to existing pallet wrapping machinery that will overcome or minimise the problem of detached film web tail ends.

A still further preferred aim of the present invention is to provide pallet film wrapping machinery that might be operated using conventional electric power without requiring compressed air actuating machines.

SUMMARY OF THE INVENTION

According to a first aspect, a wrapping film handling mechanism is provided for use with loaded pallet wrapping machinery including a rotatable turntable on which a pallet carrying goods to be wrapped is placed for wrapping, plastic wrapping film being dispensed onto the loaded pallet with a wrapping direction opposite to a rotation direction of said turntable, said film handling mechanism having a pair of gripping jaws pivotally mounted to move between a first inactive position and a second active position adapted to grip wrapping film therebetween, each said gripping jaw having a gripping portion along one zone that engages wrapping film when the gripping jaws are in said second active position, said handling mechanism including actuation means to move said gripping jaws from said first inactive position to said second active position, and wherein said actuation means for said gripping jaws moves said gripping jaws bodily in the wrapping direction as said gripping jaws are also pivoted from the first inactive position to said second active position. Conveniently the pair of gripping jaws are mountable to a peripheral region of said rotatable turntable. Preferably said gripping jaws are pivoted in relatively opposite directions when moving to said first inactive position. Conveniently, a pivot axis of the pair of gripping jaws is located above an upper plane of said pallet placed on said rotatable turntable.

The gripping jaws may be urged by spring means towards one of said first inactive position or said second active position, said gripping jaws being engageable by a movable engagement member mounted externally to the rotatable turntable, said engagement member selectably moving said film gripping jaws against urging forces applied by said spring means. Conveniently said wrapping film handling mechanism further includes a film pressing arrangement to press separately laid layers of said wrapping film on the loaded pallet against one another, said wrapping film pressing arrangement being movable from a first inactive position to a second active position, movement of said film pressing arrangement between said inactive and said active positions causing said film gripping jaws to move against forces applied by said spring means. Said film pressing arrangement may carry said movable engagement member, although the movable engagement member may be separate to the film pressing arrangement. Conveniently, the film pressing arrangement is, in use, mounted adjacent to but outwardly of the rotatable turntable. In one embodiment, the film pressing arrangement includes a rotatable cam plate engageable with a part of said actuation means when in said first inactive position as the film pressing arrangement moves towards said second active position, said cam plate being rotatable to move said gripping jaws to said second active position gripping said plastic film. The cam plate may be rotated by an electric motor drive.

The wrapping film handling mechanism may further include latch means to retain said gripping jaws in said second active position, said latch means being activated by movement of said gripping jaws to said second active position. The aforesaid mechanism further may include latch release means to selectably release said latch means, said latch release means including at least one electrically operated solenoid or motor. In a further embodiment, the wrapping film handling mechanism includes latch release means to selectably release said latch means, said latch release means including a selectably movable release mechanism positioned adjacent to and radially outwardly of the turntable, said release mechanism including, in an operative position, a cam member engageable with a cam element of said latch means, the engagement of said cam member with said cam element causing said disengagement of said latch means.

It is preferred that the actuation means for the gripping jaws, moves both said gripping jaws bodily in a direction opposite to the wrapping direction as said gripping jaws are also pivoted from said second active position to said first inactive position.

Conveniently, at least one of the gripping jaws is spring loaded towards the other of said gripping jaws when said pair of gripping jaws are positioned in said second active position.

In a preferred embodiment, the gripping jaws are mounted for rocking movement together about a rocking axis transverse to a pivoting axis of said gripping jaws.

In a still further embodiment, each said gripping jaw also has roller means freely rotatable about an axis spaced from the one zone. Preferably, the aforesaid axis extends parallel with a longitudinal direction of each said gripping jaw. The roller means on each said gripping jaw may include one or more rollers, the or each said roller having an axis of rotation common with said axis, and the or each said roller presents a moving surface spaced at least partially beyond a remainder of the gripping jaw. Each moving surface created by the roller (or rollers) may be treated to provide a non-stick effect relative to the wrapping film.

The aforesaid wrapping film handling mechanism may be provided for inclusion in and modification of an existing pallet wrapping machine. Alternatively, the wrapping film handling means might be incorporated in newly built pallet wrapping machines.

In a still further embodiment of the present invention, a wrapping film handling mechanism is provided for use with loaded pallet wrapping machinery including a rotatable turntable on which a loaded pallet is placed for wrapping, plastic wrapping film being dispensed onto the loaded pallet with a wrapping direction opposite to a rotation direction of said turntable, said film handling mechanism having a pair of gripping jaws pivotally mounted to move between a first inactive position and a second active position adapted to grip wrapping film therebetween, each said gripping jaw having a gripping portion along one zone that engages wrapping film when the gripping jaws are in said second active position, said handling mechanism including actuation means to move said gripping jaws from said first inactive position to said second active position, said gripping jaws being mounted for rocking movement together about a rocking axis transverse to a pivoting axis of said gripping jaws. Conveniently, said gripping jaws are capable of limited rocking movement towards or away from the loaded pallet when in use.

In yet another embodiment of the present invention, a wrapping film handling mechanism is provided for use with loaded pallet wrapping machinery including a rotatable turntable on which a loaded pallet is placed for wrapping, plastic wrapping film being dispensed onto the loaded pallet with a wrapping direction opposite to a rotation direction of said turntable, said film handling mechanism having a pair of gripping jaws pivotally mounted to move between a first inactive position and a second active position adapted to grip wrapping film therebetween, each said gripping jaw having a gripping portion along one zone that engages wrapping film when the gripping jaws are in said second active position, said handling mechanism including actuation means to move said gripping jaws from said first inactive position to said second active position, such said gripping jaw also having roller means freely rotatable about an axis spaced from said one zone.

In a still further embodiment of the present invention, a wrapping film handling mechanism is provided for use with loaded pallet wrapping machinery including a rotatable turntable on which a loaded pallet is placed for wrapping, plastic wrapping film being dispensed onto the loaded pallet with a wrapping direction opposite to a rotation direction of said turntable, said film handling mechanism having a pair of gripping jaws pivotally mounted to move between a first inactive position and a second active position adapted to grip wrapping film therebetween, each said gripping jaw having a gripping portion along one zone that engages wrapping film when the gripping jaws are in said second active position, said handling mechanism including actuation means to move said gripping jaws from said first inactive position to said second active position, said one zone in said second active position extending upwardly from, a position spaced above a top surface of the pallet.

The present invention also anticipates providing a pallet wrapping machine including a wrapping film handling mechanism as described above, the pallet wrapping machine further including a said turntable rotatable about a first upright axis for supporting a pallet carrying goods to be wrapped, said turntable carrying said wrapping film gripping mechanism at or adjacent a peripheral edge of said turntable for rotation with said turntable, said pallet wrapping machine further including plastic wrapping film dispensing means having mounting means for a roll of plastic wrapping film whereby said roll of plastic wrapping film is rotatable about a second upright axis with said plastic wrapping film being dispensed therefrom when a said loaded pallet is wrapped, first drive means for moving said plastic wrapping film dispensing means in a movement direction parallel to or coincident with said second upright axis selectably upwardly or downwardly along said movement direction, and press means to press a tail end of said plastic wrapping film against film already wrapped onto said loaded pallet at a height spaced upwardly from said pallet.

The aforesaid pallet wrapping machine may further include heat seal means to form at least one heat seal line between said tail end and an underlying layer of the plastic wrapping film, the heat seal means forming the heat seal line or a plurality of said heat seal lines in a direction substantially aligned with a wrapping direction of said plastic wrapping film.

Preferably, the pallet wrapping machine includes a mounting structure provided adjacent to and radially outwardly of said turntable, said mounting structure carrying said film pressing arrangement and said heat seal means, said mounting structure being selectably movable by second drive means from said first inactive position to said second active position whereby said press means of said pressing arrangement and said seal means are located directed towards said tail end of said plastic wrapping film wrapped, in use, onto a said loaded pallet. Conveniently the mounting structure is rotatable about a third upright pivot axis when moving from said first inactive position to said second active position. The machine may further include plastic wrapping film separation means for separating plastic wrapping film on said roll of plastic wrapping film from plastic wrapping film already wrapped, said plastic wrapping film separation means being carried by said mounting structure. Preferably the first drive means and the second drive means includes one or more electric motors.

In accordance with another aspect, a wrapping film handling mechanism is provided for use with loaded pallet wrapping machinery including a film gripping mechanism adapted, in use to be mounted to a peripheral region of a rotatable turntable of said loaded pallet wrapping machinery, said film gripping mechanism including a pair of pivotable film gripping jaws having an elevated film gripping position and a lowered inactive position, said pivotable film gripping jaws being urged by spring means towards one of said elevated film gripping position or said lowered inactive position, and a film pressing arrangement adapted, in use, to be mounted adjacent to the rotatable turntable of said loaded pallet wrapping machinery, said film pressing arrangement being movable from an inactive position to an active position and in said active position, said film pressing arrangement cooperates with said film gripping mechanism to move said film gripping jaws against forces applied by said spring means.

Preferred embodiments of the present invention will hereafter be described with reference to the accompanying drawings.

DETAILED DESCRIPTION OF THE PREFERRED EMBODIMENT

Figure 1:
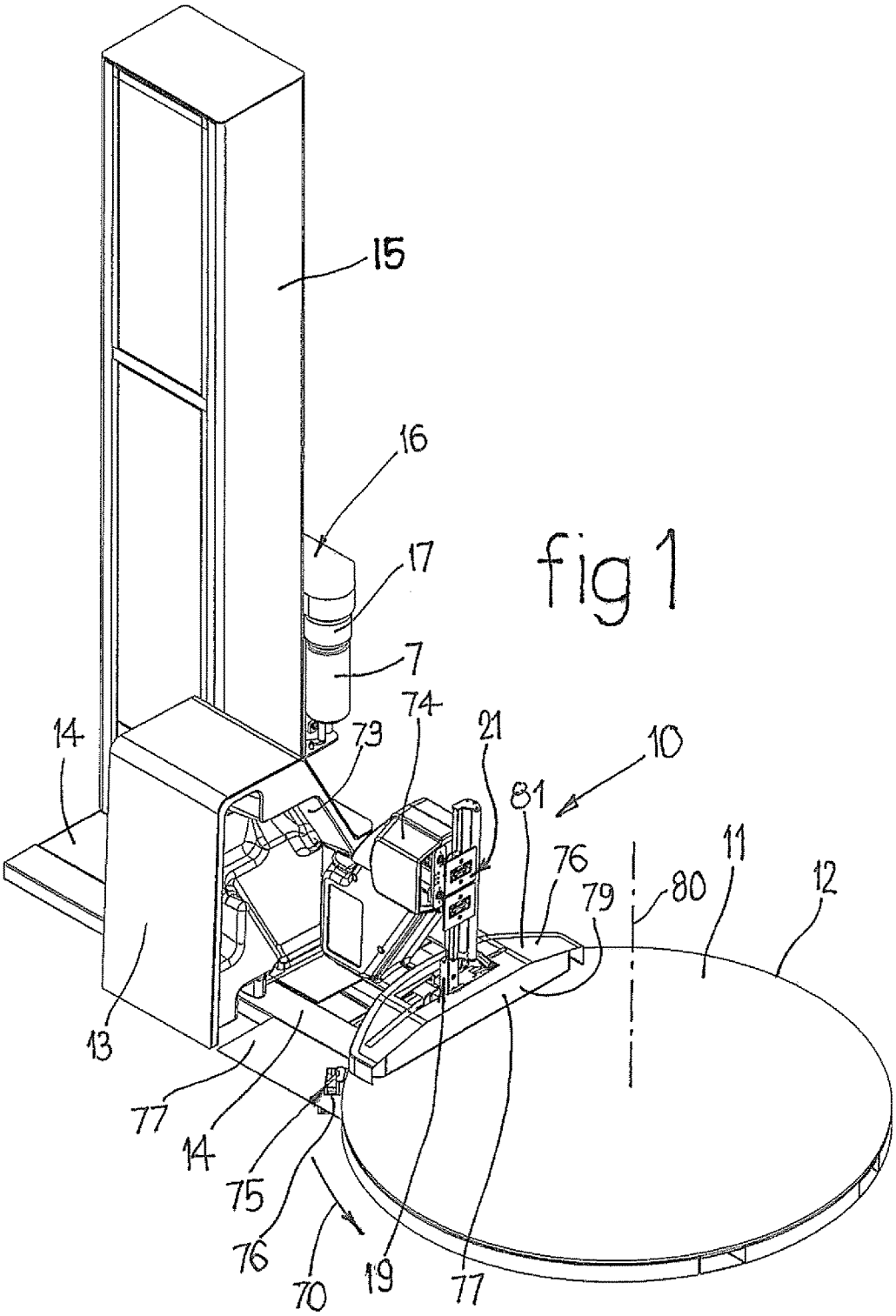
FIG. 1 is a forward perspective view from a first side of preferred pallet wrapping apparatus including wrapping film handling means according to a preferred embodiment of the present invention.
Figure 2:
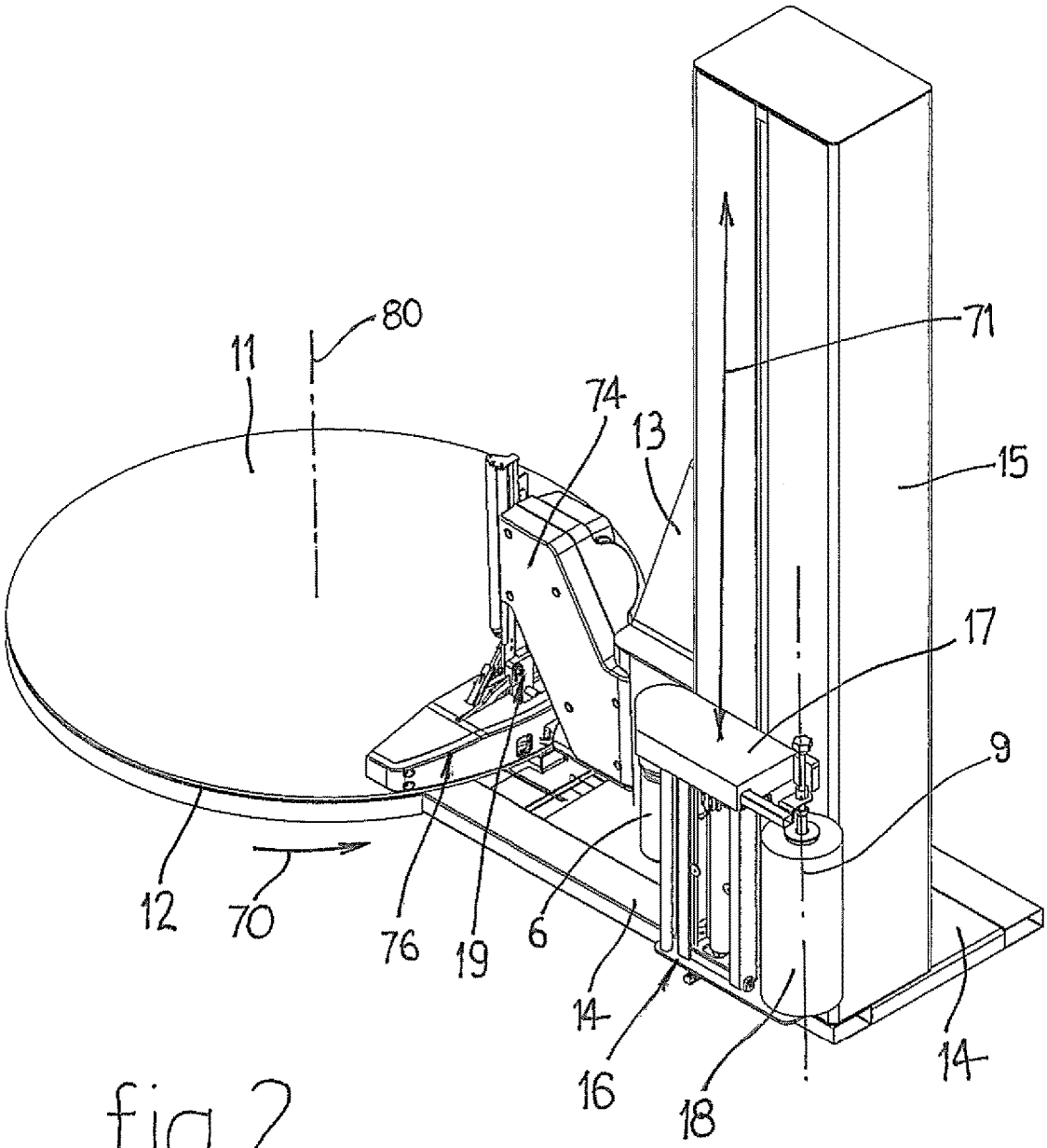
FIG. 2 is a rear perspective view of the apparatus of FIG. 1 from a second side.
Figure 3:
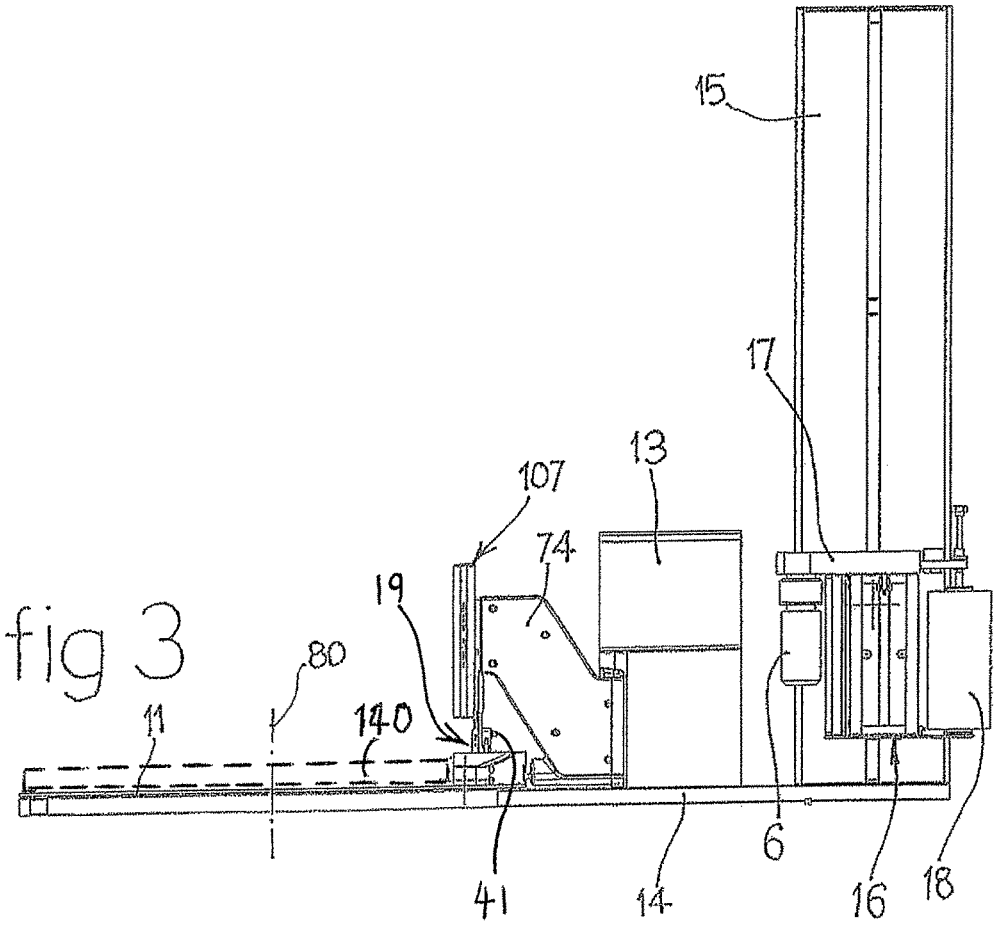
FIG. 3 is a side elevation view of the apparatus of FIG. 1 from the second side.
Figure 4:
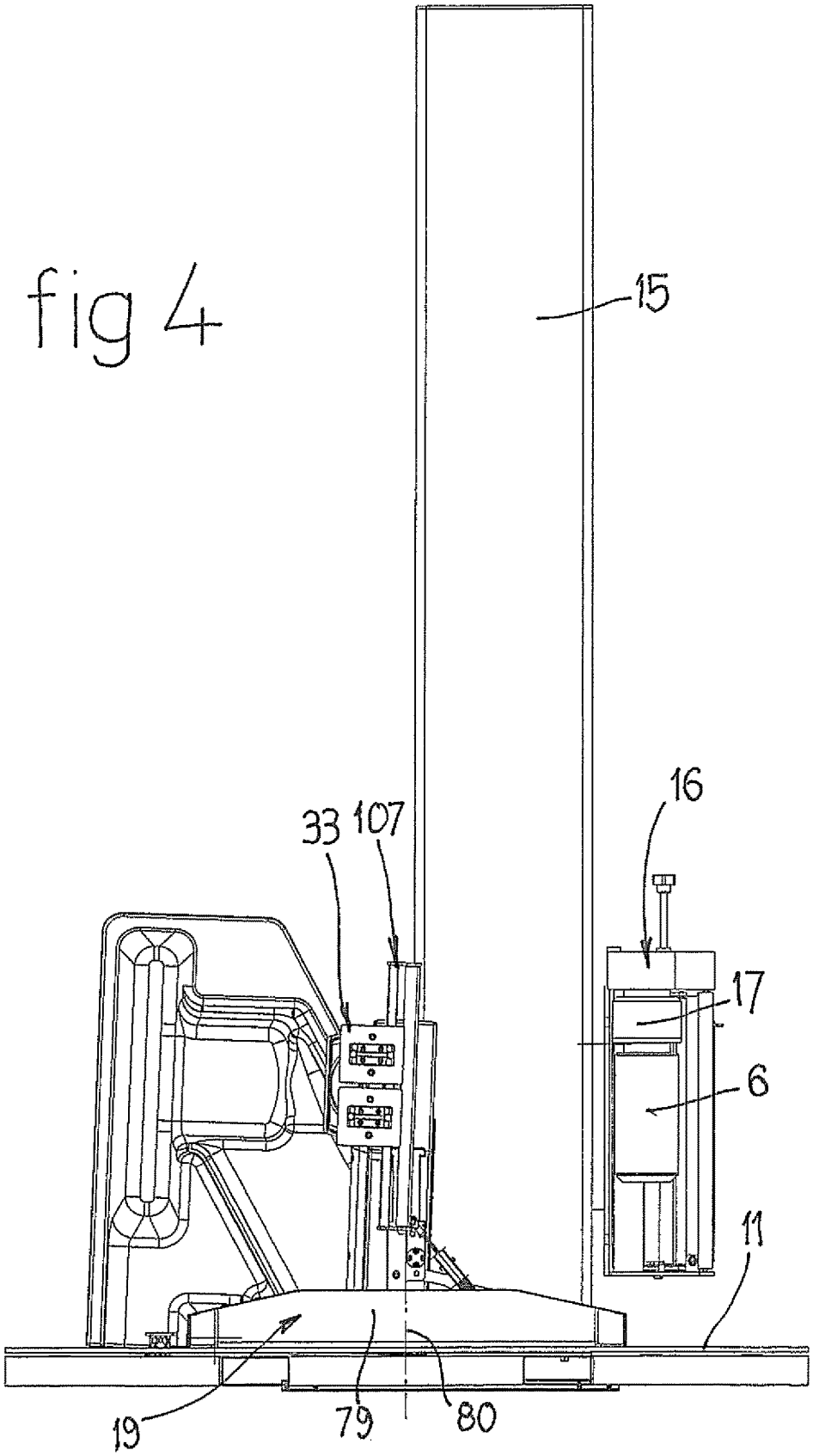
FIG. 4 is a front elevation view of the apparatus of FIG. 1.
Figure 5:
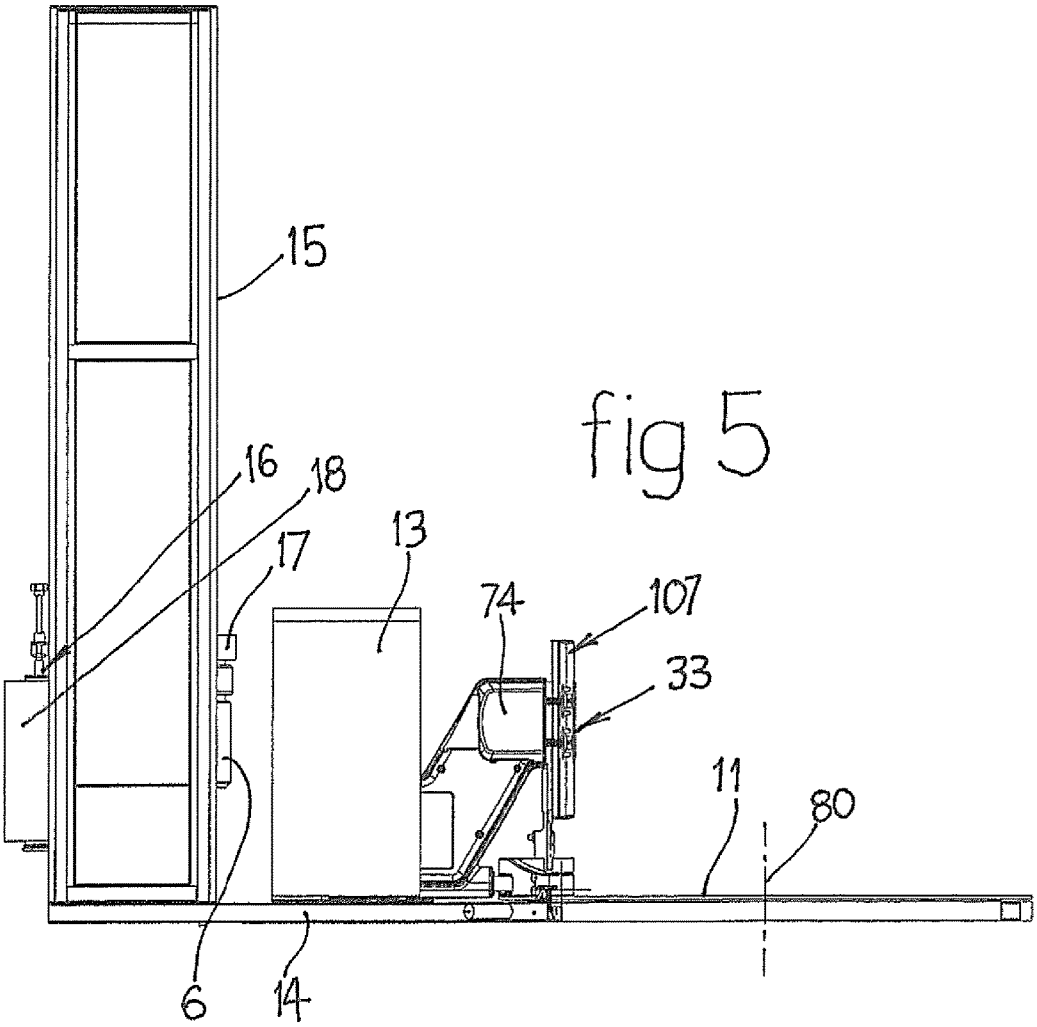
FIG. 5 is a side elevation view of the apparatus of FIG. 1 from the first side.

Referring to FIGS. 1 to 5, the pallet wrapping machinery 10 includes a rotatable turntable 11 on which a loaded pallet can be located, the pallet 140 carrying goods intended to be wrapped with plastic film. The turntable is selectably rotatable about an upright axis 80 during a loaded pallet wrapping procedure. The machinery 10 includes a stationary support base 14 carrying a support column 15 and a plastic film dispensing unit 16. The plastic film dispensing unit 16 includes drive means 17 for moving the unit 16 upwardly and downwardly along the support column 15 in the direction of arrow 9. Conveniently this drive means 17 includes an electric motor 6, chain or gear transmission or a rack and pinion drive of any known construction. The plastic film dispensing unit 16 further carries a roll of plastic film 18 in a manner permitting rotation about an upright axis permitting the film to be dispensed therefrom onto the goods loaded on the pallet carried by the turntable 11. As the plastic film dispensing unit 16 moves up and down the support column 15 as indicated by arrow 7, overlapping layers of plastic film are laid onto the pallet 140 and the loaded goods as the turntable 11 is rotated in the direction of arrow 70 about the axis 80. Conveniently, the dispensing unit 16 includes control means for controlling both the vertical movement (i.e. up or down) and the limits of movement. Conveniently the wrapping occurs to just above the upper height level of the goods and downwardly to include at least partially the top platform of the pallet 140 on which the goods are loaded. Conveniently, the control means controls the final film wrapping layers such that the tail end of the film is spaced upwardly from the level of the pallet 140. Preferably the tail end of the film is positioned generally mid way between the top and the bottom of the loaded goods on the pallet.

The machinery 10 further includes film handling mechanism 4 with a film gripping mechanism 19 and a film pressing arrangement 21. The film gripping mechanism 19 includes a protective cover 76 secured to an upper surface of the turntable 11 adjacent its periphery 12. The film gripping mechanism 19 is arranged to grip wrapping film extending from the roll 18 carried by the dispensing unit 16 at the end of a loaded pallet wrapping process prior to separating the film to be wrapped from that which is already wrapped on the loaded pallet carried on the turntable 11. The film gripping mechanism 19 holds the wrapping film from the roll 18 until a new loaded pallet wrapping process is commenced. Details of the structure and operation of the film gripping mechanism 19 will be described hereafter in relation to FIGS. 6 to 13.

The film pressing arrangement 21 may include a sealing device described in greater detail hereafter with reference to FIGS. 14 to 23. The film pressing arrangement 21 is mounted to the stationary support base 14 on an opposite side of the support column 15 to the plastic film dispensing unit 16 but generally adjacent to the rotatable turntable 11. Other physical arrangements may also be possible. The film pressing arrangement 21 includes a protective housing 13 with an open front face 73 directed towards the turntable 11 that allows operative parts of the arrangement 21 to be moved to an active outer position and be withdrawn into the protective housing 13 in an inactive position. A movable protective cover 74 covers moveable parts of the film pressing arrangement 21 including the sealing device as described in greater detail hereafter.

FIG. 1 also shows a latch release device 75 mounted adjacent to the rotatable turntable 11 projectable through an opening 76 in a floor member 77 forming part of the support base 14. The latch release device is selectably lifted by operation of an electric motor (not shown) to be engageable with the film gripping mechanism 19 as it is rotated on the turntable 11 to allow the film gripping mechanism 19 to return to its inactive state. This is described in greater detail in the following. In a possible alternative, an electrically operated solenoid could be used to release the film gripping mechanism 19.

Reference will now be made to FIGS. 6 to 13 showing in detail, the film gripping mechanism 19. The protective cover 76 includes an L shaped mounting plate 77 with a lower plate section 78 and an upright flange 79. The lower plate section 78 is secured to the turntable 11 adjacent its periphery 12 with the upright flange 79 also providing a location face for positioning a loaded pallet there against when placed on the turntable 11 for wrapping. The plate 76, the plate section 78 and the upright flange 79 are welded together. The protective cover 76 is generally completed by a formed member 81 with a top wall 127 and outer side wall 128. The top wall 127 has an aperture 129 far allowing the gripping jaws of the mechanism 19 and related parts to extend therethrough or be lowered to an inactive position within the protective cover 76, and the outer side wall 128 has an aperture 130 allowing the cam roller 66 to project through the wall 128 and to allow parts of the press and sealing arrangement 21 to operatively engage with parts of the gripping mechanism 19 as further described hereafter. The formed member 81 of the protective cover 76 is secured to L shaped mounting plate 77 by fasteners at either end.

The film gripping mechanism 19 includes a pair of film gripping jaws 24, 25 that are pivotally mounted to move between lowered inactive positions (FIGS. 10, 11) and an elevated active film gripping position (FIGS. 6 to 9). Each of the gripping jaws 24, 25 have an inner film gripping edge 84, 85 adapted to confront one another in the position shown in FIGS. 6 to 9. The gripping jaw 24 has a removable plate 86 along edge 84 holding a T-shaped gasket 90 adapted to improve the film gripping effect when required. The gasket is made from a suitable elastomeric material and has a head portion directed towards the edge 85 of the gripping jaw 25 when in the elevated active position. The edges 87, 88 opposite the edges 84, 85 of the gripping jaws 24, 25 each carry freely rotatable rollers 56, 57 rotatable about an axis generally parallel to a longitudinal direction of the jaws 24, 25. Each roller 56, 57 has a moving outer surface that at least partially extends beyond the edges 87, 88 and preferably beyond the side faces of the gripping jaws 24, 25. Each roller 56, 57 may include an outer surface made from or coated with a non-stick material such as Teflon or similar. In this manner sticking or adherence of the plastic wrapping film to the jaws 24, 25 is prevented or at least minimized.

Figure 10:
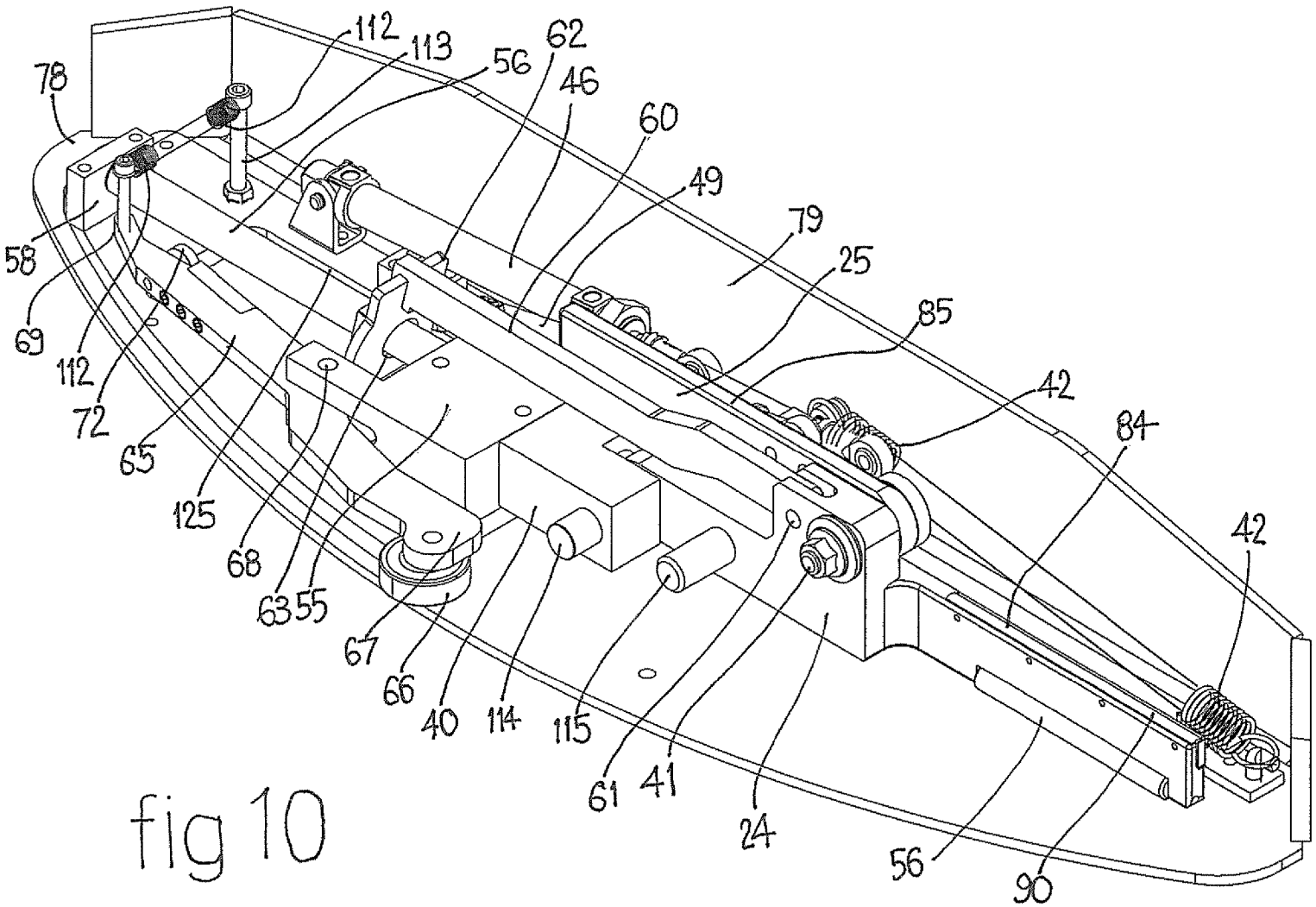
FIGS. 10 and 11 are forward perspective views similar to FIG. 6 showing the film gripping jaws in a lowered non-gripping position.
Figure 11:
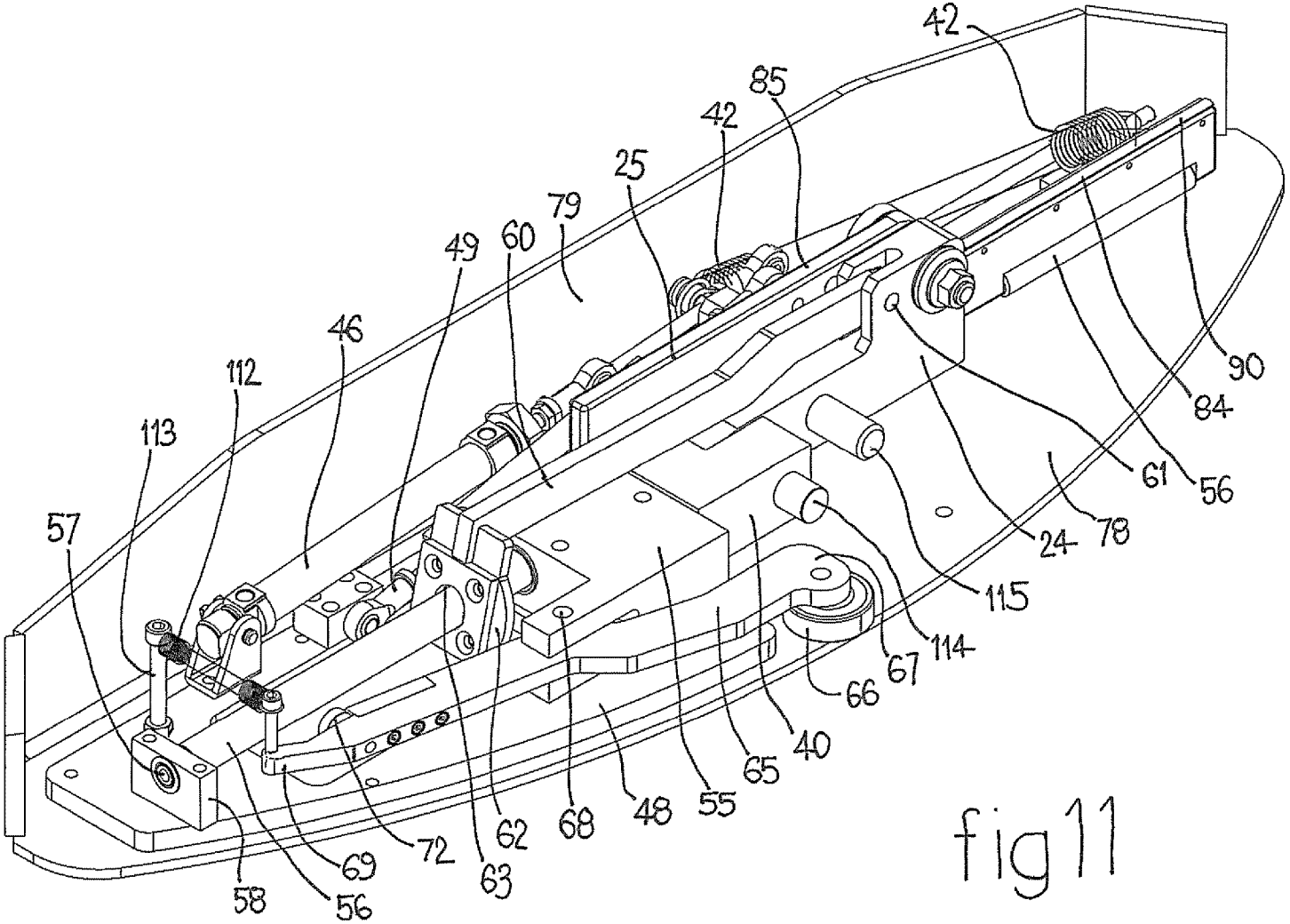
Figure 12:
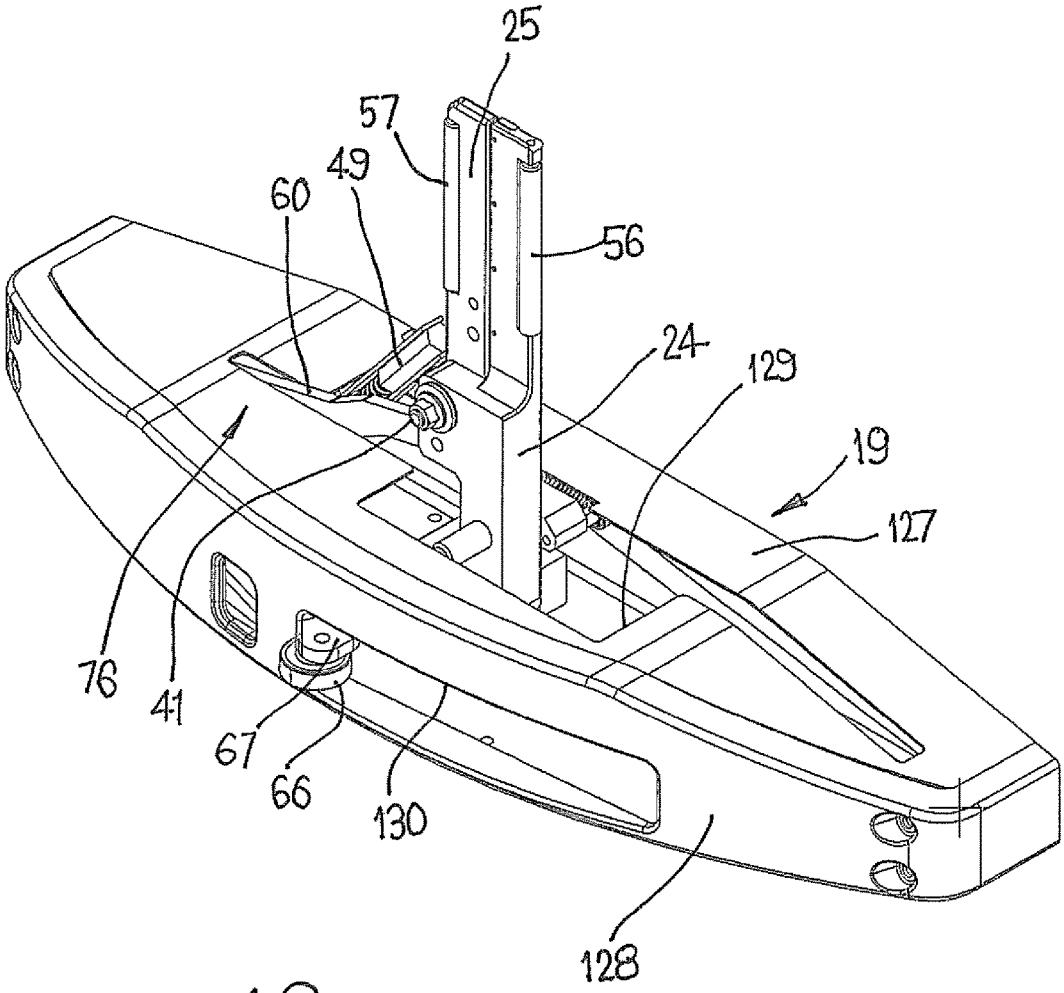
FIG. 12 is a front perspective view of the film gripping means with its mechanism at least partially enclosed by a protective cover.
Figure 13:
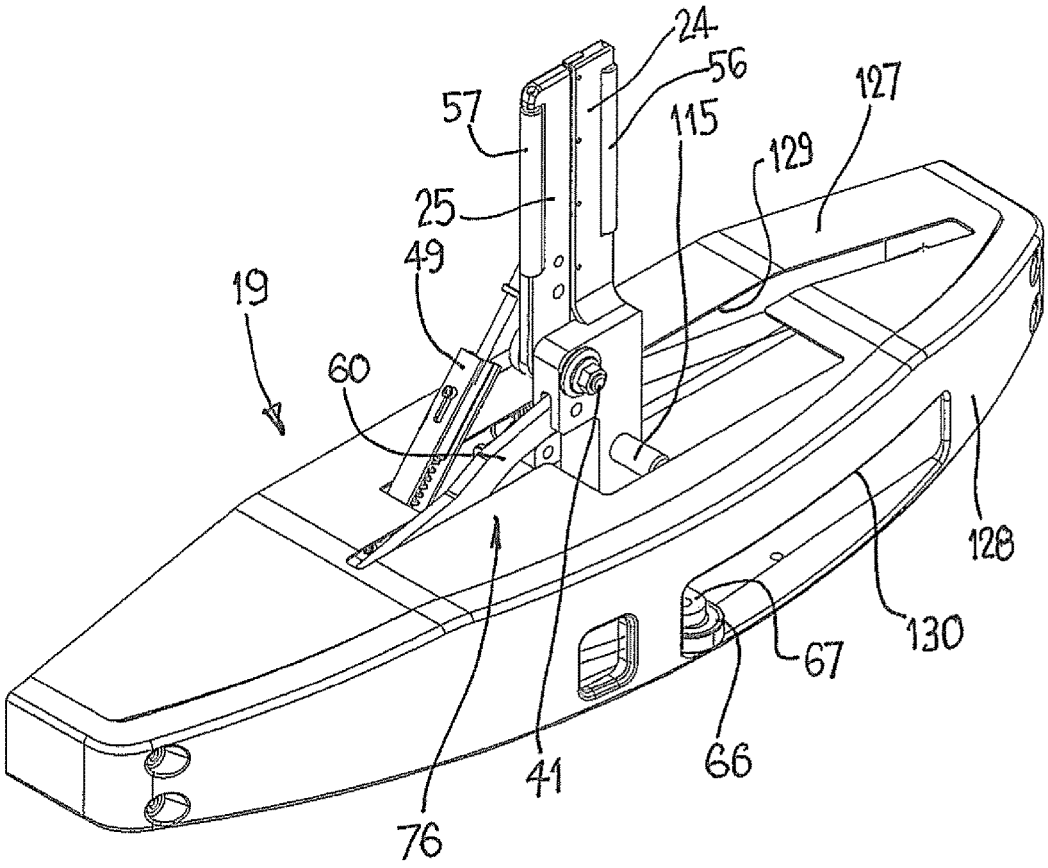
FIG. 13 is a front perspective view similar to FIG. 12 from an opposite end of the film gripping means.

The film gripping jaw 24 is pivotally connected at a lower end to a mounting block 40 with the film gripping jaw 25 being pivotally mounted at its lower end to the gripping jaw 24 at a position 41 spaced upwardly from the mounting block 40. An urging tension spring 42 has a first end 43 secured to the lower plate section 78 of the L-shaped mounting plate 77. The other end 44 of the spring 42 is connected via a pin or similar to a part 45 mounted to the gripping jaw 24, the spring end 44 being connected at a position 5 above the pivot point of the gripping jaw 24 to the mounting block 40 but below position 41. A damper member 46 extending in a direction opposite to the spring 42 from the position 5 to a connection 47 to a base plate 48, the base plate 48 being, in use, connected to the lower plate section 78 of the L-shaped mounting plate 77. A link member 49 has a first upper end 50 connected to the gripping jaw 25 at a position upwardly of its pivot connection at position 41. The opposite end 51 of the link member 49 is connected to the base plate 48. The link member 49 is made in two parts 52 and 53 with spring means 54 urging the upper part 52 to move away from the lower part 53. In this manner with the gripping jaws 24, 25 in the elevated position (FIGS. 6 to 9), the spring means 54 urges the gripping jaw 25 against the gripping jaw 24. Movement of the part 52 relative to the part 53 is retained within limits by a slide mechanism 64. As shown in FIGS. 10, 11, and in the absence of any other countering forces, the tension spring 42 pivotally moves the gripping jaw 24 in a clockwise direction (FIG. 6) around its lower pivot axis to position the jaw 24 generally horizontally. In so moving, the pivot position 41 of the gripping jaw 25 moves to the right (FIG. 6) and the link member 49 pulls the gripping jaw 25 to the left or anticlockwise about its pivot connection at 41 (FIG. 6) to also position the gripping jaw 25 generally horizontally but extending opposite to the gripping jaw 24.

Figure 6:
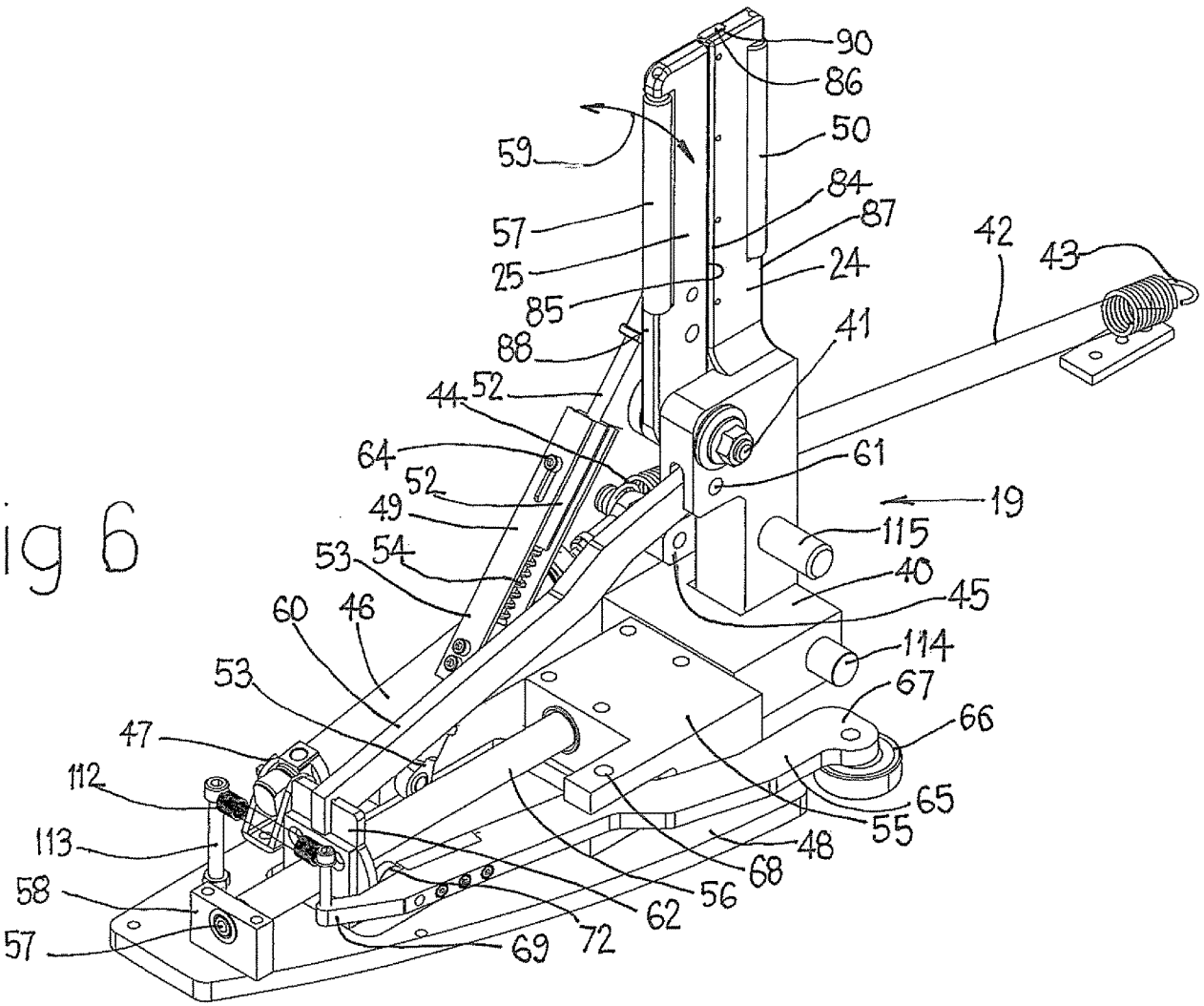
FIG. 6 is a front perspective view of film gripping means shown in FIGS. 1 to 5 carried by the turntable with the film gripping jaws shown in an elevated film gripping position.

The film gripping mechanism 19 further includes a stationary mounting block 55 connected to the base plate 48. A rocker shaft 56 extends through the mounting block 55 and is rotatable relative to the mounting block 55. One end 57 of the rocker shaft 56 is supported in a bearing block 58 with the rocker shaft 56 being rotatable relative to the bearing block 58 and the mounting block 55. The opposite end of the rocker shaft 56 is mounted in and connected to the mounting block 40 where rotational movement of the rocker shaft 56 causes the mounting block 40 to rock and thereby the gripping jaws 24 25 are permitted limited rocking movement in the direction of arrow 59 (FIG. 6).

In use, rocking movement of the gripping jaws 24, 25 occurs towards and away from a loaded pallet to be wrapped positioned on the turntable 11 with the pallet positioned against the upright flange 79.

Figure 7:
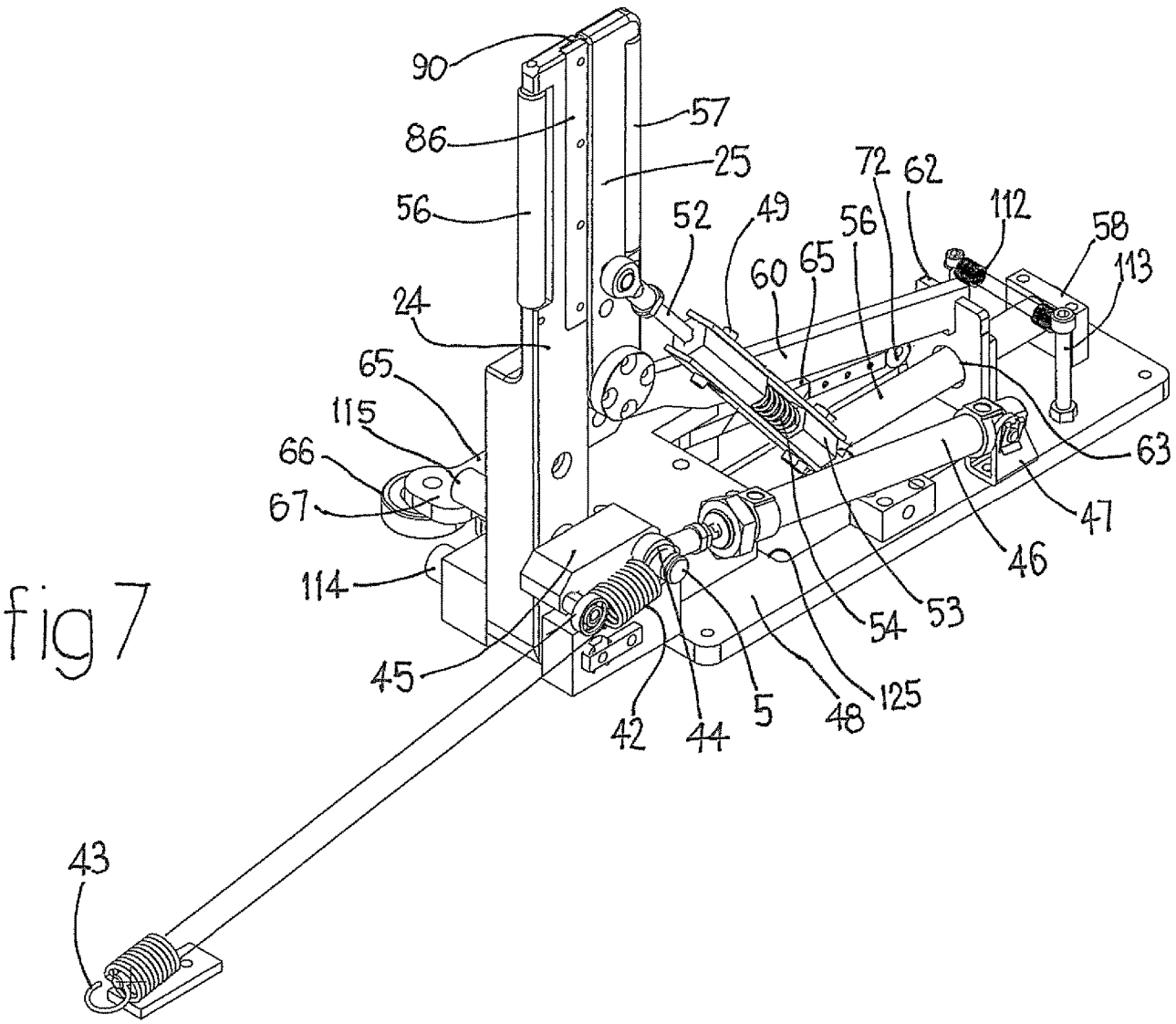
FIG. 7 is a rear perspective view of the film gripping means shown in FIG. 6.
Figure 8:
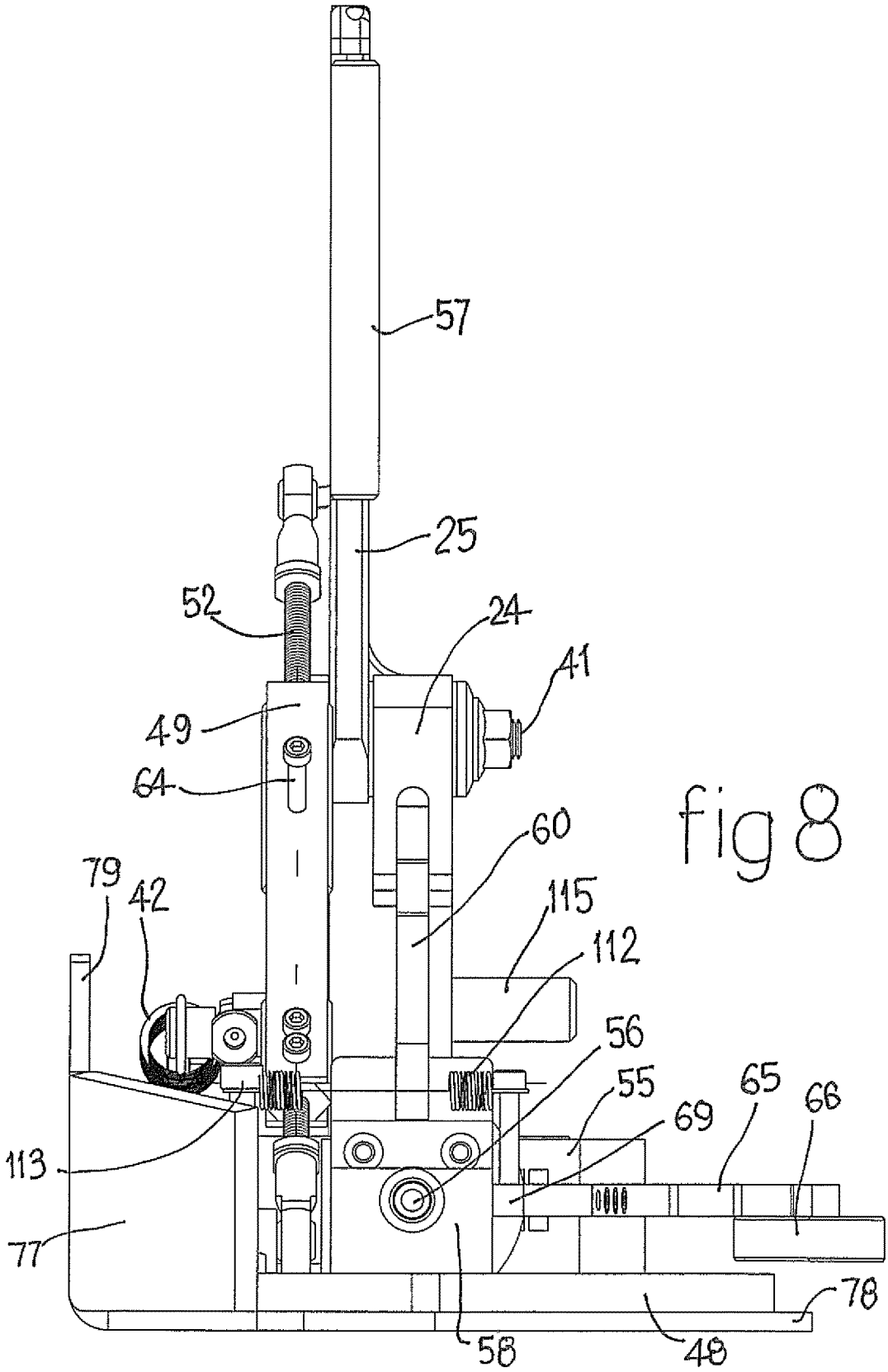
FIG. 8 is an end elevation view of the film gripping means shown in FIGS. 6 to 8 from a first end.
Figure 9:
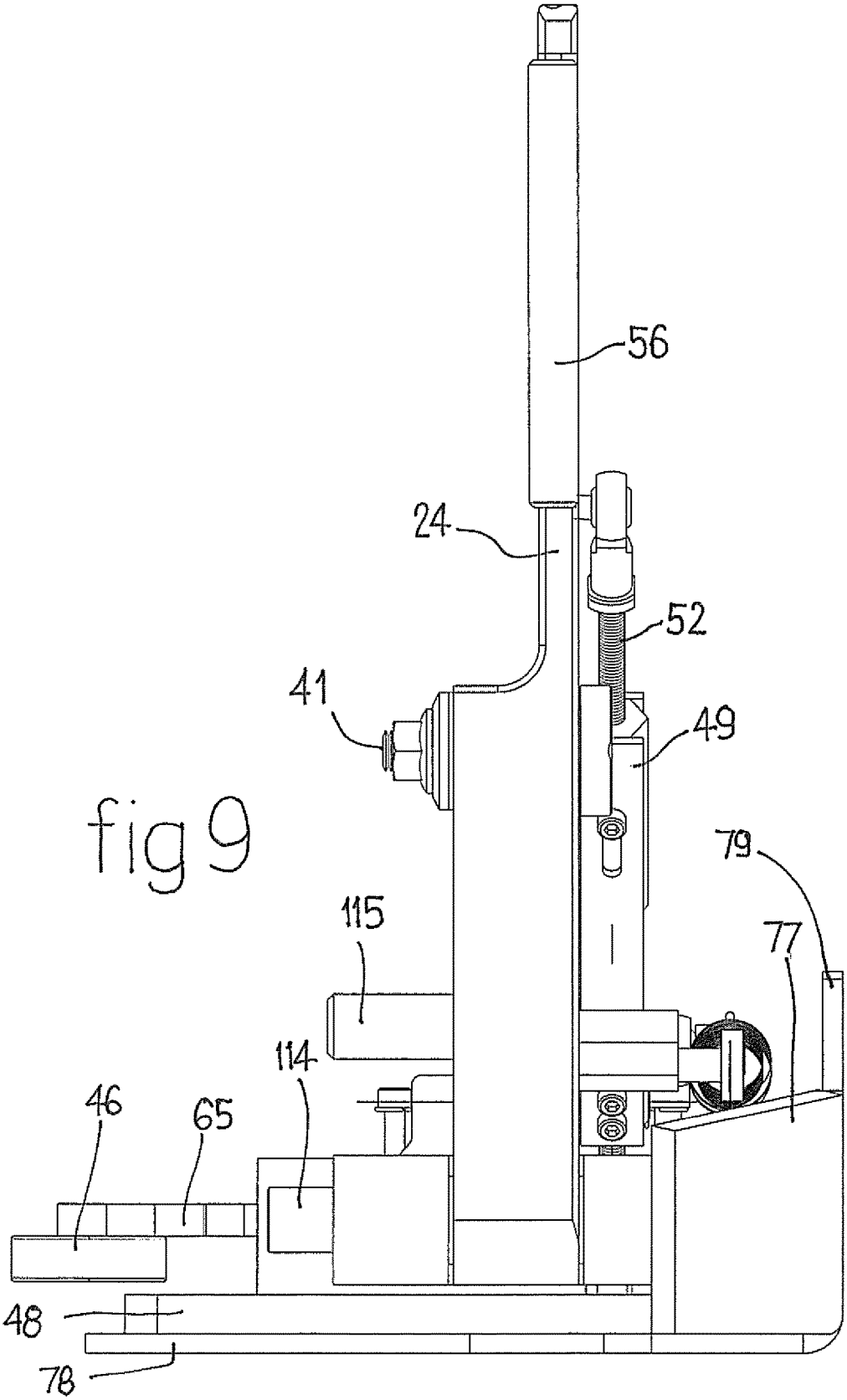
FIG. 9 is an end elevation view of the film gripping means shown in FIGS. 6 to 8 from a second end opposite to said first end.

Further an arm 60 is provided pivotally connected at 61 to the gripping jaw 24. The pivot connection 61 is positioned between the pivot connection of the gripping jaw 24 to the mounting block 40 and the pivot connection point 41 of the gripping jaw 25 to the gripping jaw 24. The opposite end of the arm 60 is welded to a slide plate 62 with an opening 63 permitting the slide plate 62 to slide along the rocker shaft 56. A further arm 65 is provided with a cam wheel 66 at one end 67 and a pivot 68 connection to the stationary mounting block 55 intermediate the ends of the arm 65. A second end 69 of the arm 65 is connected via a spring 112 to a fixed point 113 such that the second end 69 of the arm 65 is urged towards the rocker shaft 56. A second cam wheel 72 is rotatably mounted to the arm 65 adjacent to the second end 69 to latch the slide plate 62 preventing it from sliding along the rocker shaft 56 toward the stationary mounting block 55 as shown in FIGS. 6, 7. If the end 67 of the arm 65 is moved inwardly toward the rocker shaft 56 either by the cam wheel 66 engaging with a latch release member 75 or by some other means such as an electrically operated solenoid, then the cam wheel 72 can be moved selectably to an outer non-blocking position allowing the slide plate 62 to slide along the rocker shaft 56. Conveniently the slide plate 62 is guided by engagement within a recess or opening 125 in the base plate 48. However, in the position shown in FIGS. 6, 7, the arm 60 is latched in the illustrated position retaining the gripping jaws 24, 25 in the elevated film gripping position. The film gripping mechanism 19 further includes a first laterally extending pin 115 extending from the gripping jaw 24 and a second laterally extending pin 114 from the mounting block 40, both pins 115, 114 extending towards the front side of the mechanism 19, that, in use, towards the periphery of the turntable 11. Operation of the film gripping mechanism 19 will be explained in the following.

Figure 14:
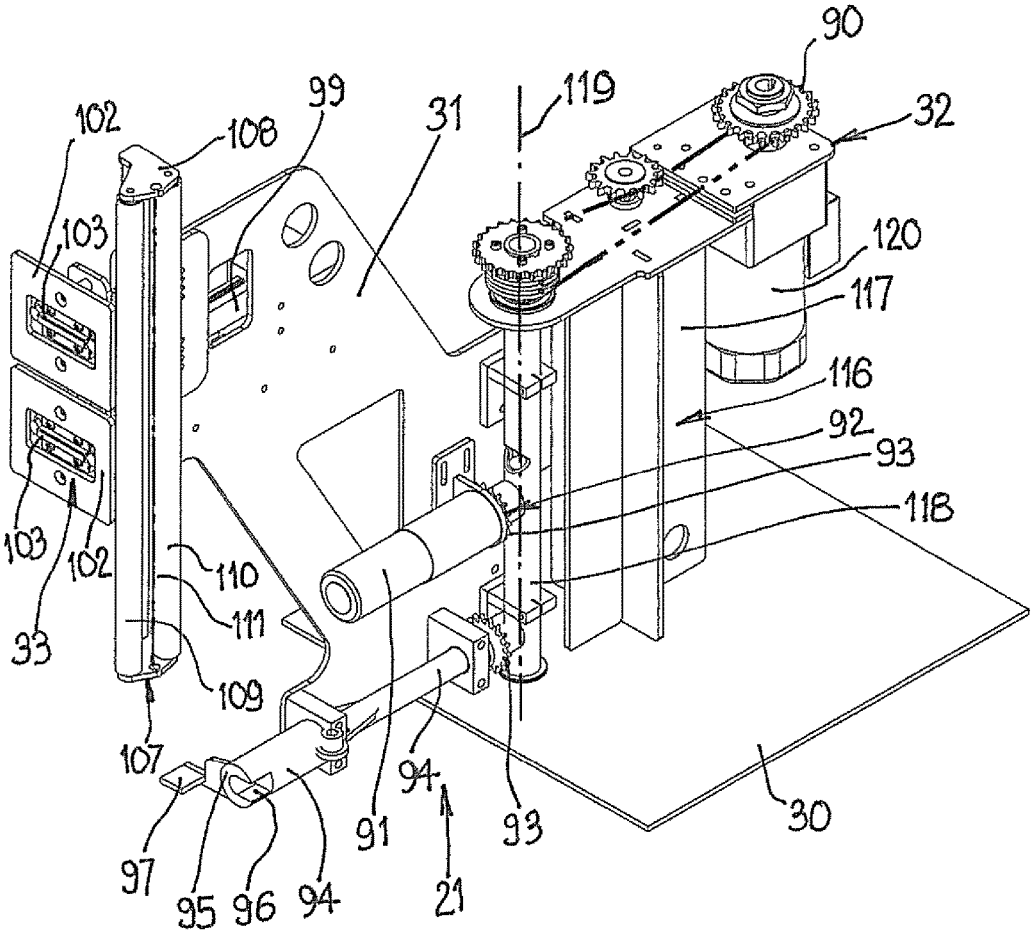
FIG. 14 is a front perspective view of film press means, film seal means and film cutting means carried on a mounting structure.
Figure 15:
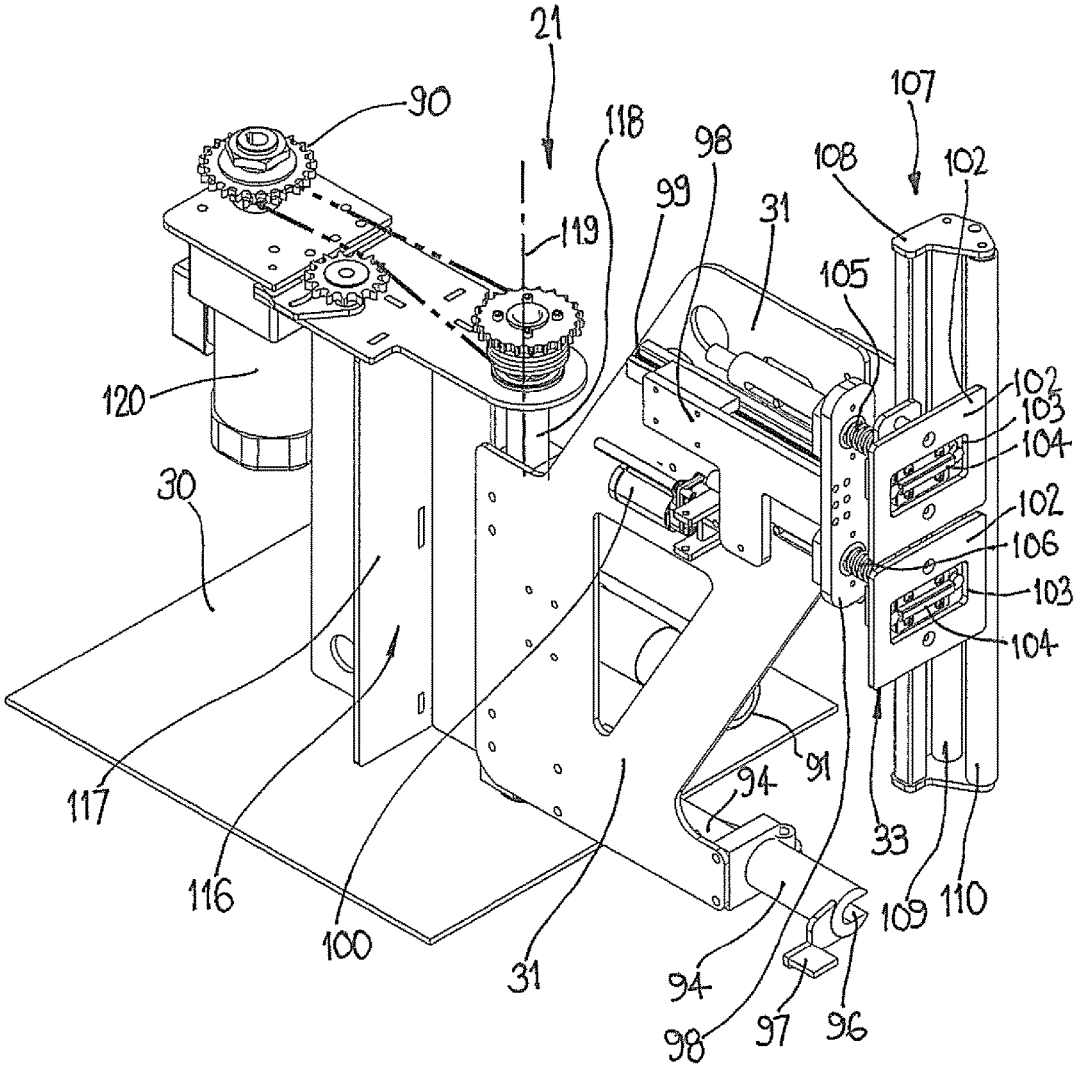
FIG. 15 is a front perspective view of FIG. 14 from an opposite side.
Figure 16:
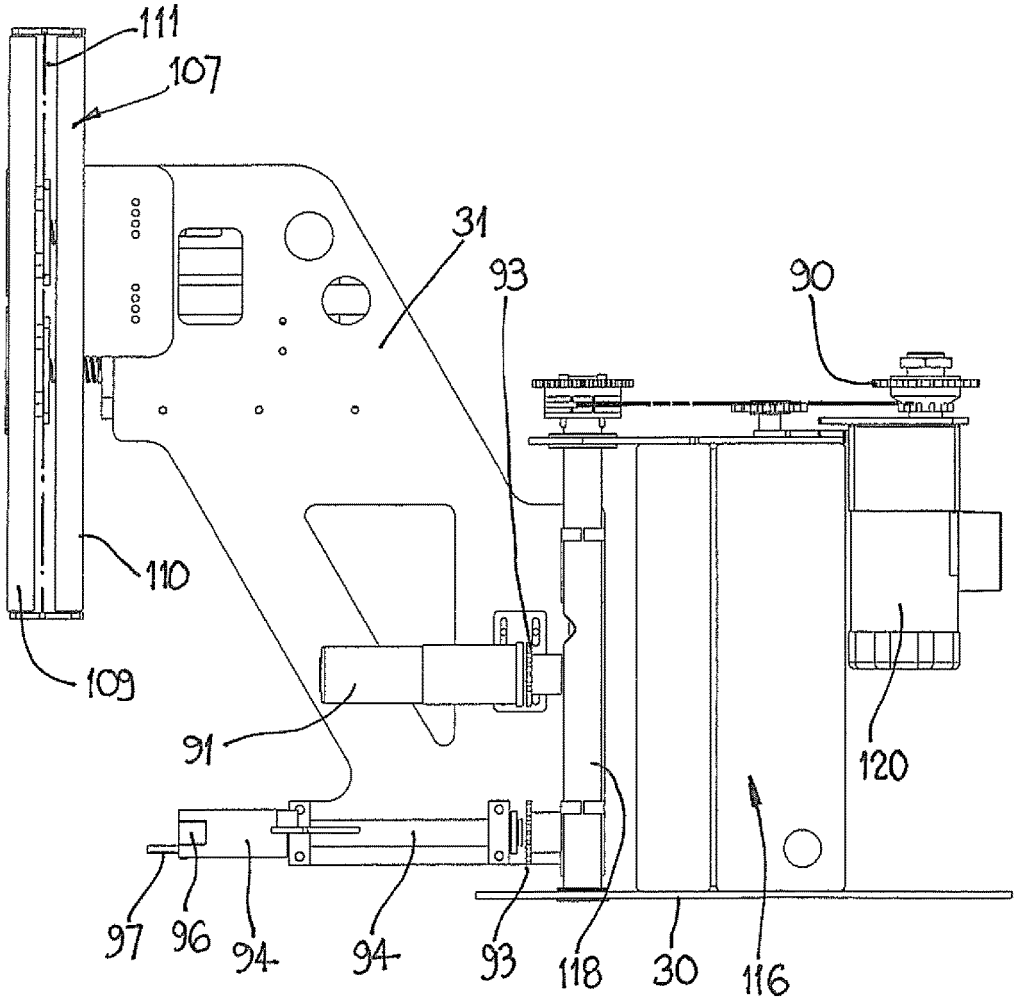
FIG. 16 is a side elevation view of FIG. 14 from a first side.
Figure 17:
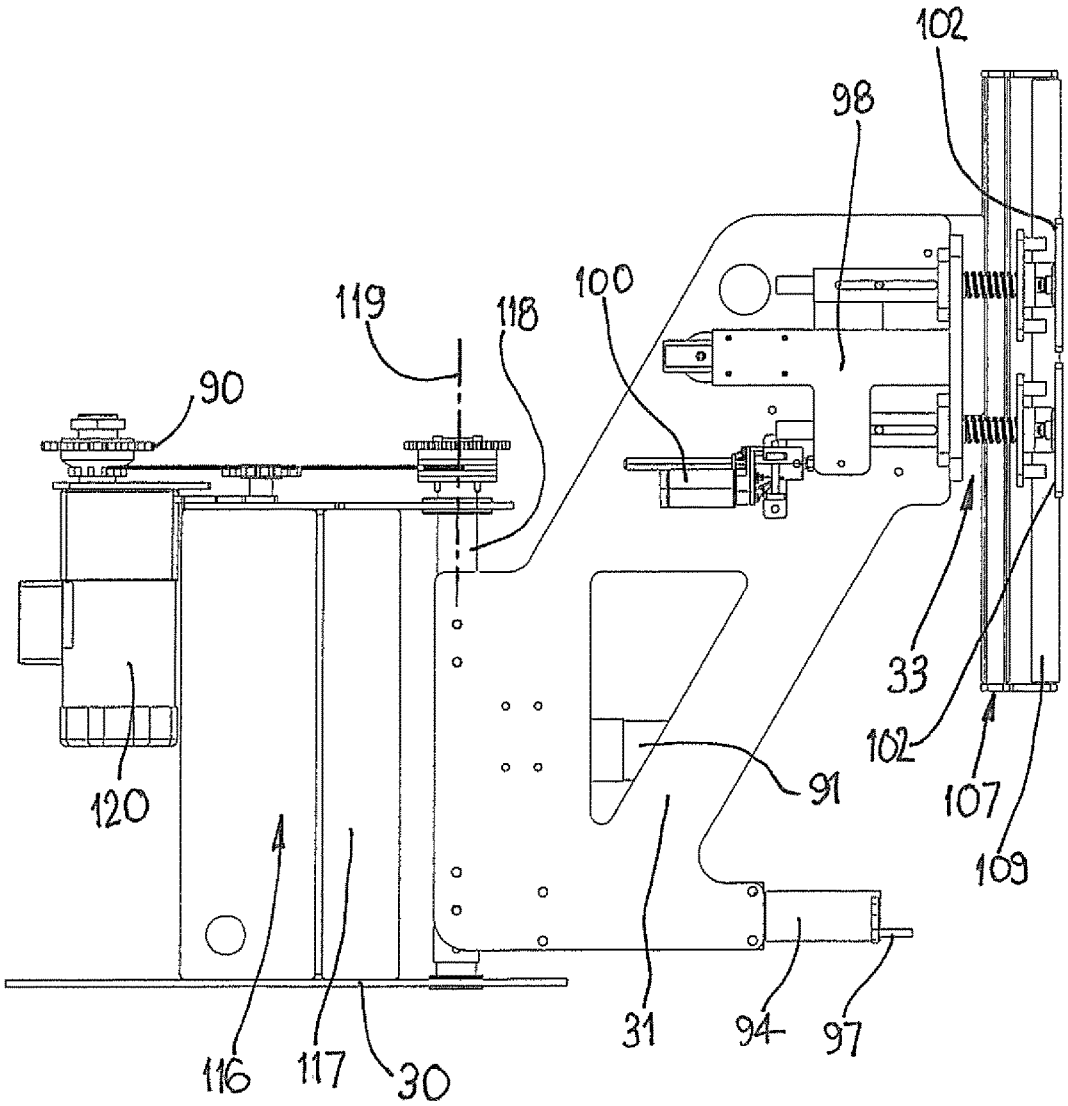
FIG. 17 is a side elevation view of FIG. 14 from the opposite side to FIG. 16.
Figure 18:
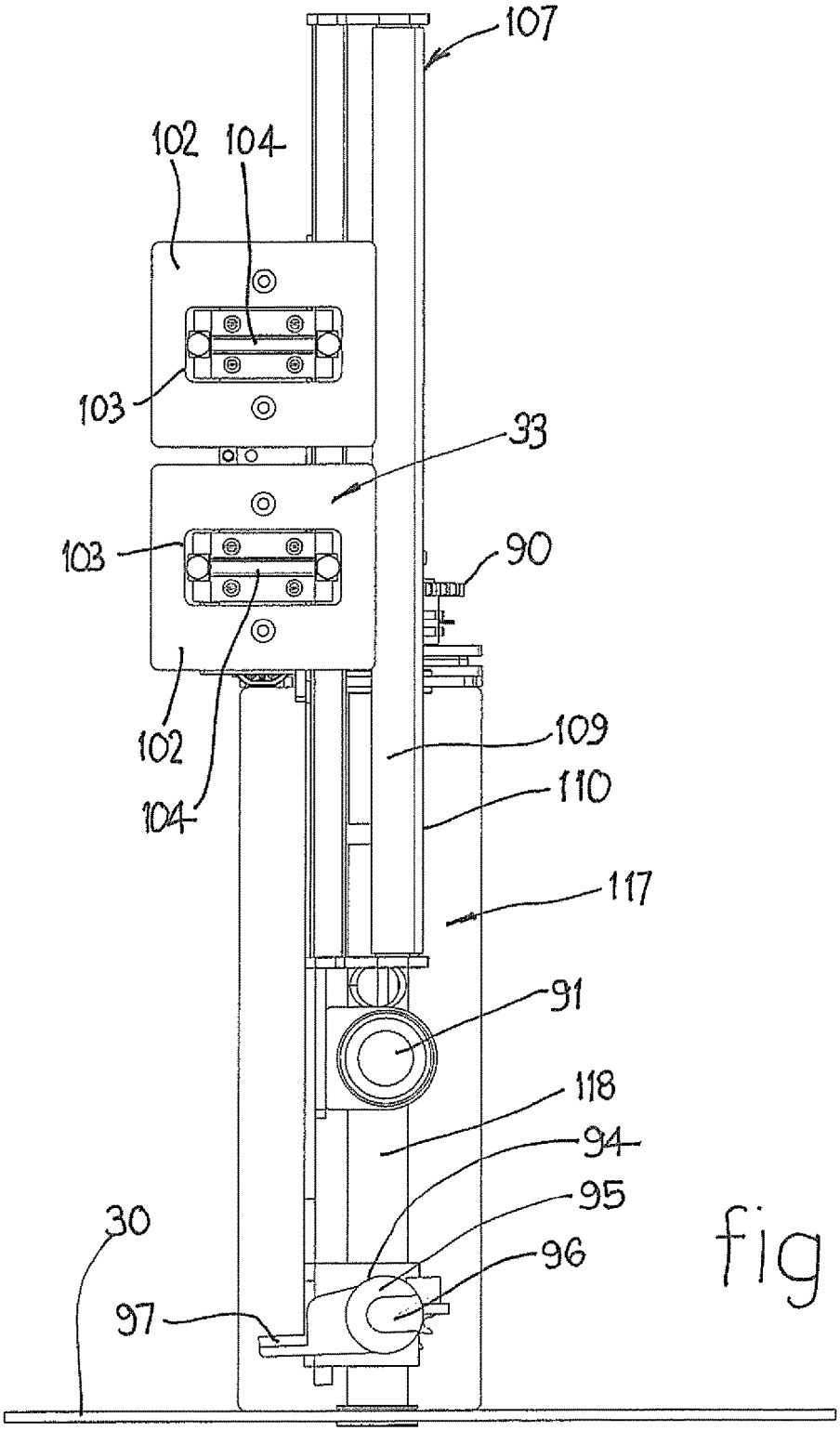
FIG. 18 is a front elevation view of FIG. 14.
Figure 19:
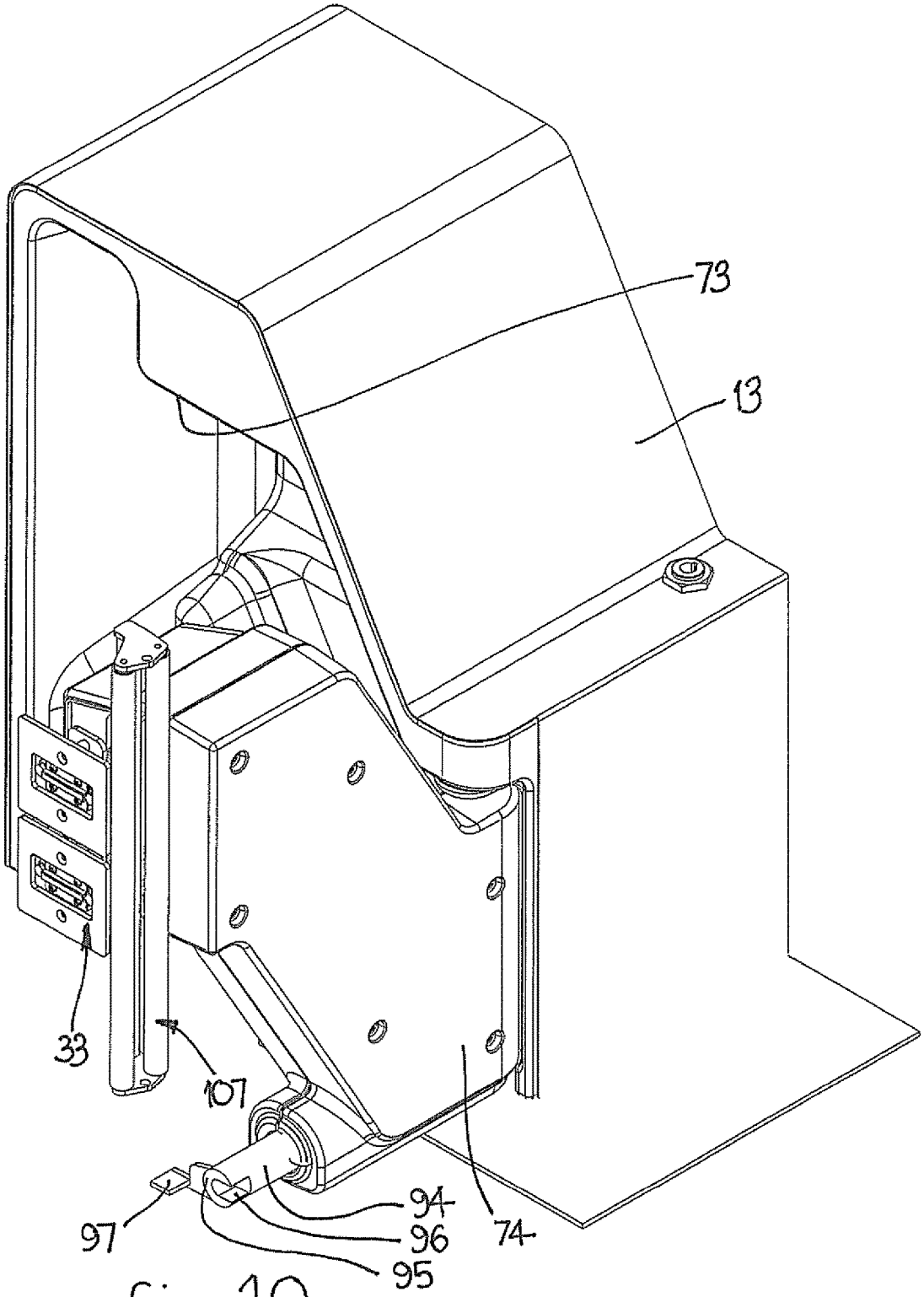
FIG. 19 is a front perspective view similar to FIG. 14 but showing the apparatus within a protective cover means.
Figure 20:
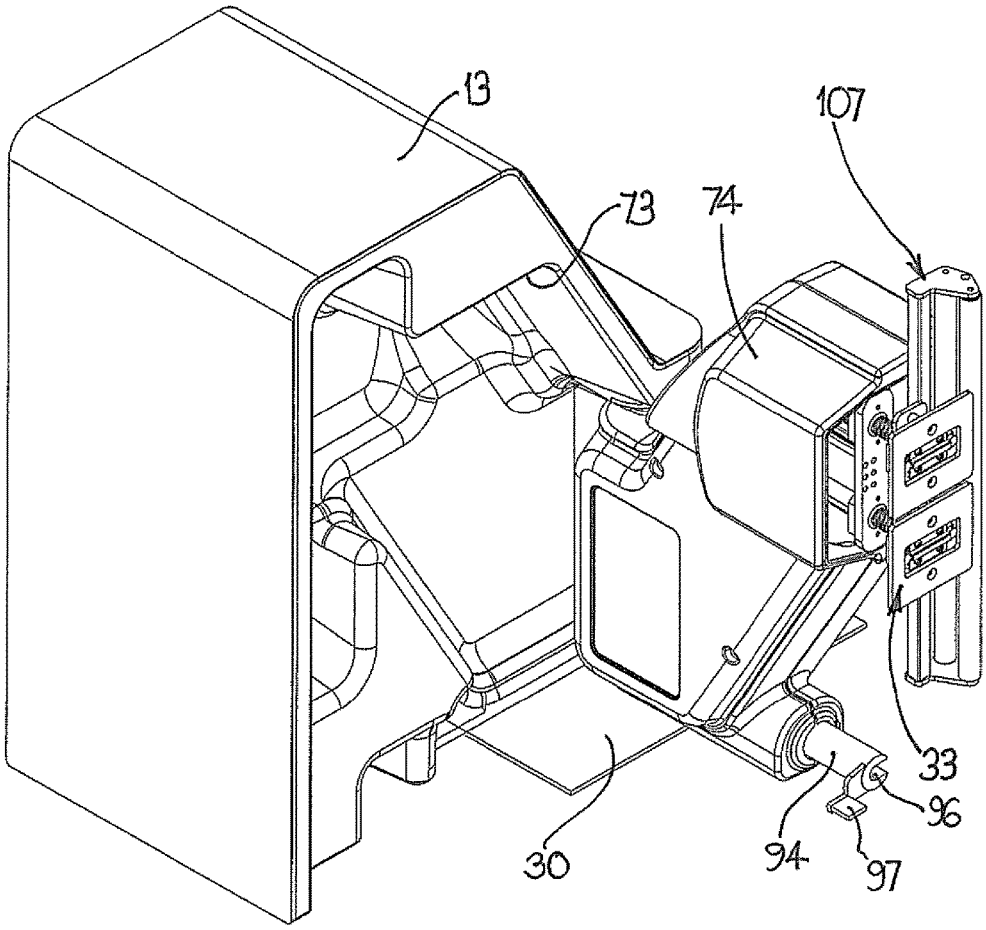
FIG. 20 is a front perspective view similar to FIG. 15 again with the apparatus within the protective cover means.
Figure 21:
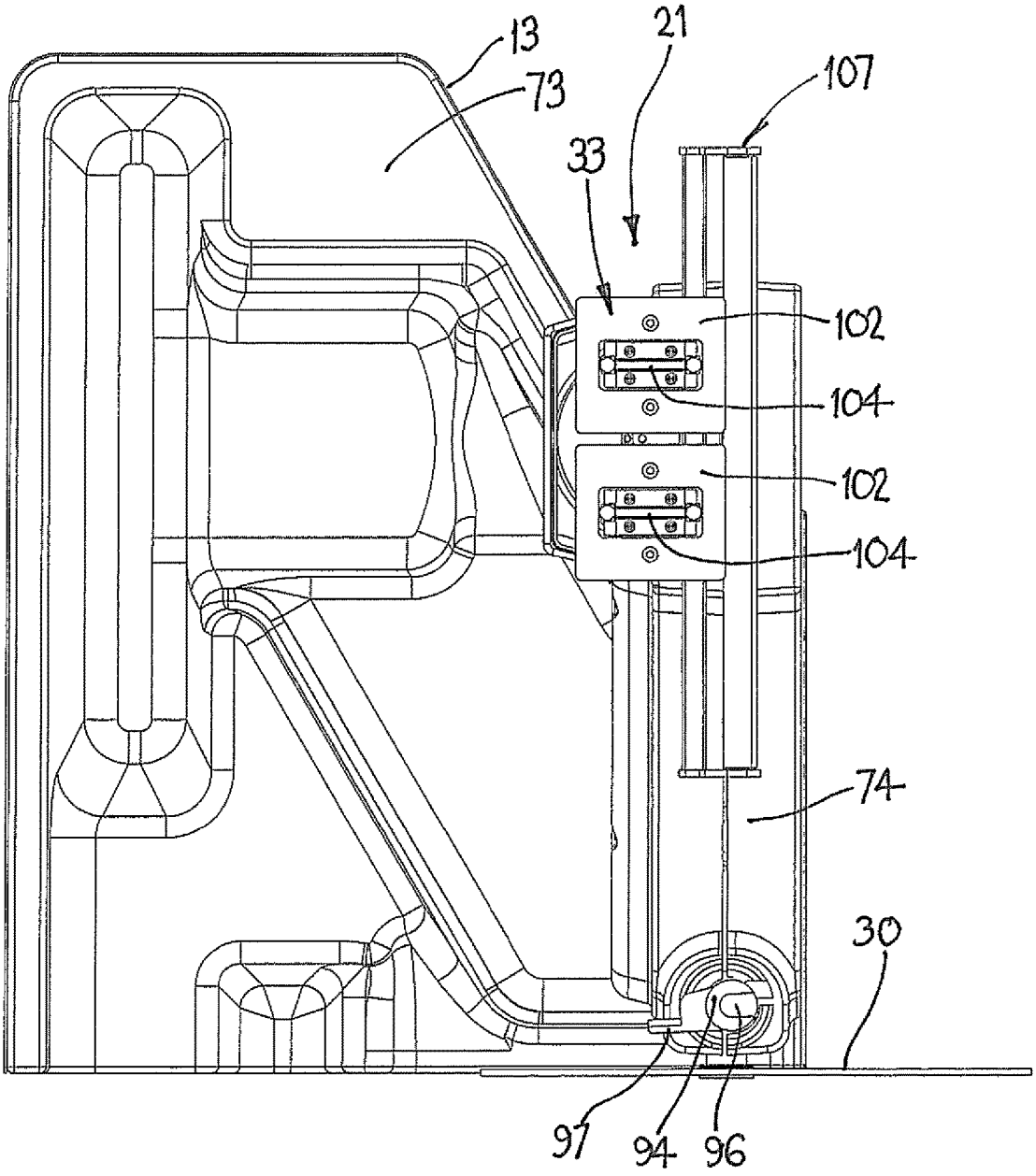
FIG. 21 is a front elevation view similar to FIG. 18 but also including the protective cover means.
Figure 22:
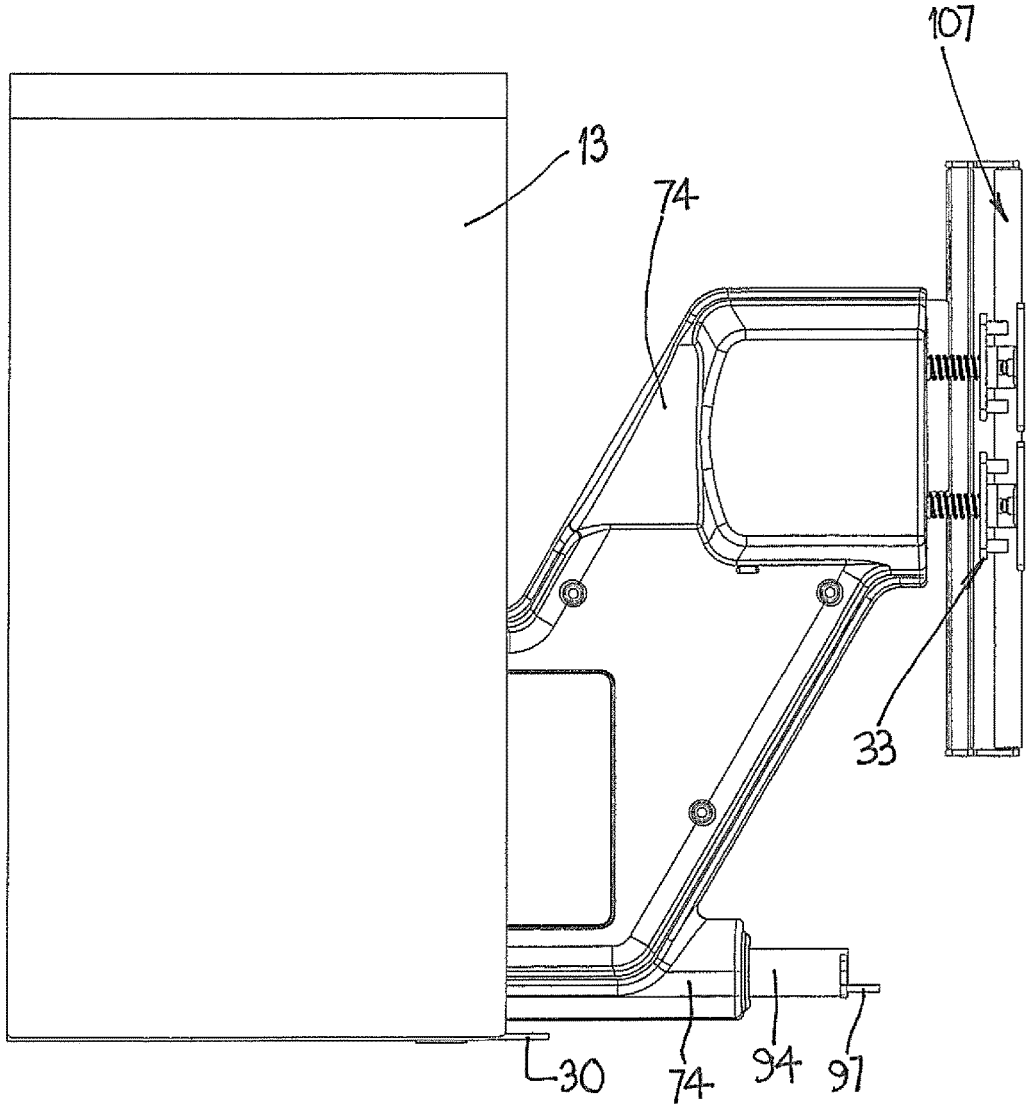
FIG. 22 is a side elevation view similar to FIG. 16 but also including the protective cover means.
Figure 23:
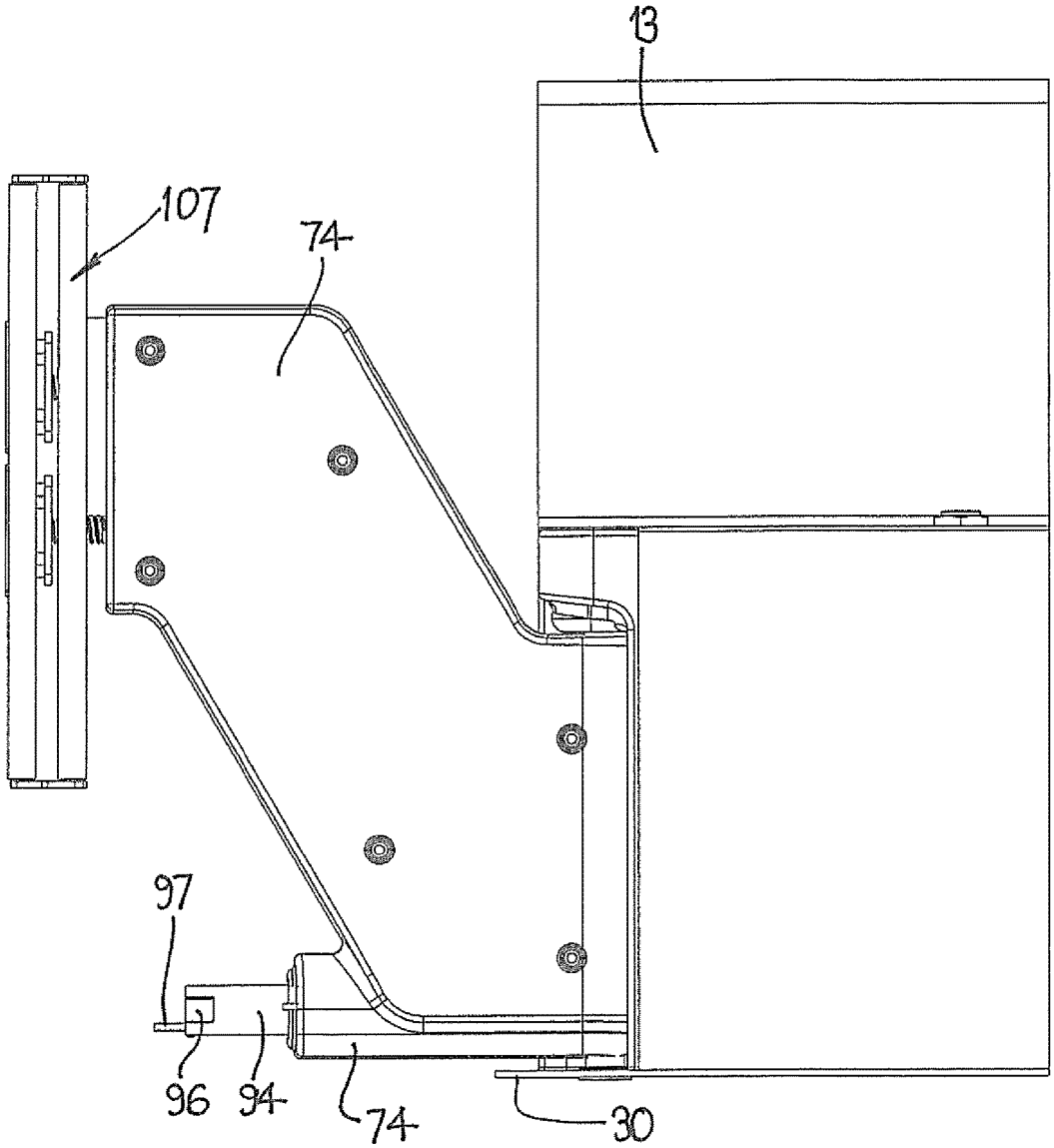
FIG. 23 is a side elevation view opposite to FIG. 22.

The film pressing and sealing arrangement 21 is shown in detail in FIGS. 14 to 23. The arrangement 21 includes a mounting structure 116 with a base plate 30 that is mounted, in use, to the support base 14, and an upright support means 117. The mounting structure 116 further includes a main support arm 31 pivotally mounted to part 118 of the upright support means 116. The support arm 31 thereby is rotatable about a third upright axis 119 defined by the part 118 of the upright support means 116. A drive arrangement 32 is provided to drive the main support arm 31 from an inactive position to an active position and in a reverse direction from the active position to an inactive position. The drive arrangement 32 includes one or more electric motors 120, a suitable drive train 90 and control means whereby compressed air actuators are not required. A pressing and sealing head 33 is mounted at an outer region of the support arm 31. FIG. 14 illustrates the active position of the support arm 31 where, in use, the pressing and sealing head 33 is directed towards a loaded pallet on the turntable 11. The inactive position of the support arm 31 would be approximately 90° rotated in a clockwise direction from the position shown in FIG. 14.

The main support arm 31 also carries an electric drive motor 91 driving a rotatably mounted shaft 94, via a suitable transmission 92 that in the illustrated embodiment includes sprocket wheels 93 and a drive chain (not shown). The shaft 94 as in its end 95, an open recess 96 sized and located to receive the lateral pin 114 on mounting block 40 as the support arm 31 rotates to the active position shown in FIG. 14. The end 95 of the shaft 94 also includes a laterally extending cam plate 97. Once the recess 96 is engaged over the lateral pin 114, the shaft 94 is rotated with the cam plate 97 engaging the lateral pin 115 on the gripping jaw 24. The foregoing occurs with the gripping jaws 24, 25 in their lowered inactive position (FIGS. 10, 11) and rotation of the shaft 94 causes the cam plate 97 to engage the lateral pin 115 and move the jaw 24 to its elevated active position. The gripping jaw 25 indirectly also moves to the elevated active position in response to movement of the jaw 24.

The pressing and sealing head 33 will now be described with reference to FIGS. 14 to 18. The pressing and sealing head 33 of the pressing and sealing arrangement 21 includes a sub frame support 98 carried by slide members 99 mounted to the main support arm 31. An electric motor 100 is provided to drive the sub frame support 98 along the slide members 99 to be moved in a direction parallel to the support arm 31 and in the active illustrated position, towards a loaded pallet on the turntable 11. The sub frame support 98 carries at its forward region, a pair of rectangular press plates 101, 102, each with a central rectangular opening 103. A heat seal member 104 is located within the rectangular openings 103 but are independently mounted permitting independent movement of the press plates 101, 102 relative to the heat seal members 104. Spring means 105, 106 are provided to urge the press plates 101, 102 outwardly relative to the sub frame support 98. A plastic film cutting device 107 is also mounted to the free outer end region of the main support arm 31. The cutting device 107 includes a vertically disposed support frame 108 supporting rollers 109, 110 extending vertically. The rollers 109, 11 are intended to, in use, engage against the plastic wrapping film as the arm 31 is moved and as such may include non-stick surfaces to minimize sticking on adherence with the film. A hot wire separation device 111 extends vertically and between the rollers 109, 110 but is position slightly outwardly relative to the rollers 109, 110.

Other possible wrapping film separation or cutting devices could be employed either on a manual, automatic or semiautomatic basis.

Operation of the apparatus 10 will now be described. A goods loaded pallet ready for wrapping may be placed on the turntable 11 with plastic wrapping film extending, from the dispensing roll 18 to be held by the gripping jaws 24, 25. In this position, the turntable 11 might be rotated while the end of the film remains gripped by the jaws 24, 25. This drags film from the roll 18 and wraps same about the goods on the pallet. Depending on the number of revolutions of the turntable, one or more wrapping film layers are laid onto the goods on the pallet and may at least partially enclose part of the gripping jaws 24, 25 still in the elevated position and holding the forward end of the wrapping film. In this phase, the turntable 11 might rotate through one to several turns. At a predetermined stage, the latch release device 75 is raised into the path of the cam wheel 66 on the latch arm 65 to push the end 67 of the arm 65 inwardly. This moves the end 69 of the arm 65 outwardly to release the plate 62 so that it can slide along the rocker shaft 56. The spring 42 is continuously urging the gripping jaw 24 to try to move to its lowered inactive position and therefore the arm 60 and slide plate 62 are also urged to move in this direction by the spring 42. Accordingly, once the latch plate 62 is released, it commences to slide along the rocker shaft 56 and both gripping jaws 24, 25 pivot towards their lowered inactive position (FIGS. 10, 11). If necessary, the gripping jaws slide under any overlaying film webs that may have already been laid. Preferably overlaying layers are kept to a minimum. The rocking of the gripping jaws 24, 25 towards the loaded pallet and the bodily movement of the gripping jaws 24, 25 when moving to their inactive position, assist with this process.

Once the jaws 24, 25 are in their lowered positions, the wrapping of the pallet continues in a conventional manner with the wrapping film dispensing unit 16 moving upwardly and downwardly as desired to lay partially overlapping film layers around the goods loaded pallet. When sufficient layers have been laid, rotation of the turntable 11 ceases with the film being laid located at a midway height at least approximating the height of the gripping jaws 24, 25 and the pressing and sealing head 33 in their respective active positions. The turntable 11 also ceases its rotation with the film gripping mechanism 19 facing the film pressing and sealing arrangement 21. In this position the film pressing and sealing arrangement 21 is rotated from its inactive position through 90° to its active position with the pressing and sealing head 33 directed towards the loaded and wrapped pallet. The recess 96 in the rotatable shaft 94 engages over the lateral pin 114 and the shaft 94 is rotated such that the cam plate 97 engages with the lateral pin 115 on the gripping jaw 24 to thereby pivot the jaw 24 (and the jaw 25) to their elevated film gripping position against the forces applied by spring 42. The gripping jaws 24, 25 engage and hold the film extending from the roll 18 to the wrapped loaded pallet. At the same time, the latch arm 65 and cam wheel 72 engage the latch plate 62 to prevent the gripping jaws 24, 25 from moving from their elevated position under forces supplied by the spring 42. In this position, the press and sealing head 33 is moved towards the loaded pallet, the film cutting means cuts the film to form a film tail end, and the press and sealing head 33 presses the tail end against a previously wrapped film layer and the heat sealing members create heat seal lines connecting the tail end to an underlying film layer. The heat seal lines extend conveniently in the direction of the film layers to minimize the tendency for the heat seal to break. Thereafter the wrapped loaded pallet can be removed from the turntable 11 and the press and sealing arrangement 21 can be returned to its inactive position. The apparatus 10 is then in a condition to receive a new loaded but unwrapped pallet for wrapping, the film from the roll 18 being still retained by the elevated gripping jaws 24, 25.

It will of course be appreciated that many variations to the described apparatus will be apparent to those skilled in the art within the scope of the annexed patent claims.

The invention claimed is:

1. A wrapping film handling mechanism for use with pallet wrapping machinery, having a rotatable turntable on which a pallet carrying goods to be wrapped is placed for wrapping plastic wrapping film being dispensed onto the pallet and goods with a wrapping direction opposite to a rotation direction of said rotatable turntable;

said wrapping film handling mechanism comprising:

a pair of gripping jaws pivotally mounted to move between a first inactive position and a second active position adapted to grip wrapping film therebetween, each said gripping jaw having a gripping portion along one zone that engages wrapping film when the gripping jaws are in said second active position;

actuation means to move said gripping jaws from said first inactive position to said second active position; and a pivot axis between said pair of gripping jaws located above an upper plane of said pallet placed on the rotatable turntable in use, and wherein said gripping jaws are urged by spring means towards one of said first inactive position or said second active position, said wrapping film handling mechanism further including a wrapping film pressing arrangement to press separately laid layers of said wrapping film against one another, said wrapping film pressing arrangement being moveable from a first inactive position to a second active position, movement of said film pressing arrangement between said first inactive and said second active positions causing said film gripping jaws to move against forces applied by said spring means, and wherein said film handling mechanism comprises latch means to retain said gripping jaws in said second active position, said latch means being activated, by movement of said gripping jaws to said second active position.

2. The wrapping film handling mechanism according to claim 1 wherein said pair of gripping jaws, in use are mountable to a peripheral region of said rotatable turntable.

3. The wrapping film handling mechanism according to claim 1 wherein said actuation means for said gripping jaws moves said gripping jaws bodily in the wrapping direction as said gripping jaws are also pivoted from the first inactive position to said second active position.

4. The wrapping film handling mechanism according to claim 1 wherein said wrapping film, pressing arrangement is, in use, mounted adjacent to but outwardly of said rotatable turntable.

5. The wrapping film handling mechanism according to claim 1, wherein said wrapping film pressing arrangement includes a rotatable cam plate engageable with a part of said actuation means when in said first inactive position as the wrapping film pressing arrangement moves towards said second active position, said cam plate being rotatable to more said gripping jaws to said second active position gripping said plastic film.

6. The wrapping film handling mechanism according to claim 5 wherein the cam plate is rotated by an electric motor drive means.

7. The wrapping film handling mechanism according to claim 1 further including latch release means to selectably release said latch means, said latch release means including at least one electrically operated solenoid.

8. The wrapping film handling mechanism according to claim 1 further including latch release means to selectably release said latch means, said latch release means including a selectably movable release mechanism positioned adjacent to and radially outwardly of the turntable, said release mechanism including, in an operative position, a cam member engageable with a cam element of said latch means, the engagement of said cam member with said cam element causing said disengagement of said latch means.

9. The wrapping film handling mechanism according to claim 1 wherein said gripping jaws are pivoted in relatively opposite directions when moving from said second active position to said first inactive position.

10. The wrapping film handling mechanism according to claim 1 wherein at least one said gripping jaw is spring loaded towards the other of said gripping jaws when said pair of gripping jaws are positioned in said second active position.

11. The wrapping film handling mechanism according to claim 1 wherein said gripping jaws are mounted for rocking movement together about a rocking axis transverse to a pivoting axis of said gripping jaws.

12. The wrapping film handling mechanism according to claim 1 wherein each said gripping jaw also has roller means freely rotatable about an axis spaced from said one zone.

13. The wrapping film handling mechanism according to claim 12 wherein said roller means on each said gripping jaw includes one or more rollers, the or each said roller having an axis of rotation common with said axis, and the or each said roller presents a moving surface spaced at least partially beyond a remainder of the gripping jaw.

14. The wrapping film handling mechanism according to claim 13 wherein each said moving surface is treated to provide a non-stick effect relative to said wrapping film.

15. A pallet wrapping machine comprising a wrapping film handling mechanism, said wrapping film handling mechanism comprising:

a pair of gripping jaws pivotally mounted to move between a first inactive position and a second active position adapted to grip wrapping film therebetween, each said gripping jaw having a gripping portion along one zone that engages wrapping film when the gripping jaws are in said second active position; and actuation means to move said gripping jaws from said first inactive position to said second active position, and wherein said gripping jaws are urged by spring means towards one of said first inactive position or said second active position, said wrapping film handling mechanism further including a wrapping film pressing arrangement to press separately laid layers of said wrapping film against one another, said wrapping film pressing arrangement being movable from a first inactive position to a second active position, movement of said film pressing arrangement between said first inactive and said second active positions causing said film gripping jaws to move against forces applied by said spring means, and wherein said film handling mechanism comprises latch means to retain said gripping jaws in said second active position, said latch means being activated, by movement of said gripping jaws to said second active position, said pallet wrapping machine further comprising:

a turntable rotatable about a first upright axis for supporting a pallet carrying goods to be wrapped, said turntable carrying said wrapping film gripping mechanism at or adjacent a peripheral edge of said turntable for rotation with said turntable;

plastic wrapping film dispensing means having mounting means for a roll of plastic wrapping film whereby said roll of plastic wrapping film is rotatable about a second upright axis with said plastic wrapping film being dispensed therefrom when a loaded pallet is wrapped;

first drive means for moving said plastic wrapping film dispensing means in a movement direction parallel to or coincident with said second upright axis selectably upwardly or downwardly along said movement direction; and press means to press a tail end of said plastic wrapping film against film already wrapped onto said loaded pallet at a height spaced upwardly from said pallet.

16. A pallet wrapping machine according to claim 15 further comprising heat seal means to form at least on heat seal line between said tail end and an underlying layer of the plastic wrapping film, the heat seal means forming the heat seal line or a plurality of said heat seal lines in a direction substantially aligned with a wrapping direction of said plastic wrapping film.

17. The pallet wrapping machine according to claim 16 wherein a mounting structure is provided adjacent to and radially outwardly of said turntable, said mounting structure carrying said film pressing arrangement and said heat seal means, said mounting structure being selectably movable by second drive means from said first inactive position to said second active position whereby said press means of said pressing arrangement and said seal means are located directed towards said tail end of said plastic wrapping film wrapped, in use, onto a said loaded pallet.

18. The pallet wrapping machine according to claim 17 wherein said mounting structure is rotatable about a third upright pivot axis when moving from said first inactive position to said second active position.

19. The pallet wrapping machine according to claim 17 further including plastic wrapping film separation means for separating plastic wrapping film on said roll of plastic wrapping film from plastic wrapping film already wrapped, said plastic wrapping film separation means being carried by said mounting structure.

20. The pallet wrapping machine according to claim 17 wherein said first drive means and said second drive means includes one or more electric drive motors.

* * * * *